US010181692B2

(12) United States Patent
Flaherty, IV

(10) Patent No.: US 10,181,692 B2
(45) **Date of Patent: *Jan. 15, 2019**

(54) COAXIAL CONNECTOR WITH TRANSLATING GROUNDING COLLAR FOR ESTABLISHING A GROUND PATH WITH A MATING CONNECTOR

(71) Applicant: CORNING OPTICAL COMMUNICATIONS RF LLC, Glendale, AZ (US)

(72) Inventor: Thomas Edmond Flaherty, IV, Surprise, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/793,256

(22) Filed: Oct. 25, 2017

(65) Prior Publication Data

US 2018/0131153 A1 May 10, 2018

Related U.S. Application Data

(60) Provisional application No. 62/418,308, filed on Nov. 7, 2016.

(51) Int. Cl.
*H01R 43/26* (2006.01)
*H01R 4/30* (2006.01)
(Continued)

(52) U.S. Cl.
CPC ..... *H01R 43/26* (2013.01); *H01R 4/304* (2013.01); *H01R 9/0527* (2013.01);
(Continued)

(58) Field of Classification Search
CPC .. H01R 2103/00; H01R 24/40; H01R 9/0512; H01R 9/0503; H01R 13/6485
(Continued)

(56) References Cited

U.S. PATENT DOCUMENTS 3,587,028 A * 6/1971 Uberbacher ..... H01R 13/506 439/49
5,577,924 A * 11/1996 Louwagie ..... H01R 13/7032 333/124

(Continued)

FOREIGN PATENT DOCUMENTS

JP 2003123910 A 4/2003

OTHER PUBLICATIONS

International Search Report and Written Opinion PCT/US2017/059208 dated Jan. 24, 2018

*Primary Examiner* — Abdullah Riyami
*Assistant Examiner* — Nelson R Burgos-Guntin
(74) *Attorney, Agent, or Firm* — Tamika A. Crawl-Bey

(57) ABSTRACT

Embodiments of the disclosure are directed to a coaxial connector with a translating grounding collar for establishing a ground path with a mating connector. The coaxial connector is configured to provide an electrical connection between two mating connectors. The coaxial connector includes a housing with a first conductor and a second conductor mounted within the housing. Further, the coaxial connector comprises a grounding collar mounted to the housing to provide a grounding of the coaxial connector with a mating connector that can discharge electro-static discharge build up before connections are established between the first and second conductors and a mating connector. Thus, the coaxial connector is grounded before establishing an electrical connection between the coaxial connector and a mating connector while also compensating for tolerance stack variability in the coaxial connector. Thus, a continuous and reliable electrical and grounding contact between the connectors can be made through the coaxial connector.

20 Claims, 15 Drawing Sheets

(51) Int. Cl.

| | |
|---|---|
| ***H01R 9/05*** | (2006.01) |
| ***H01R 13/514*** | (2006.01) |
| ***H01R 13/52*** | (2006.01) |
| ***H01R 24/56*** | (2011.01) |
| ***H01R 13/24*** | (2006.01) |
| ***H01R 13/648*** | (2006.01) |
| ***H01R 24/54*** | (2011.01) |
| *H01R 13/59* | (2006.01) |

(52) U.S. Cl.
CPC ..... *H01R 13/2421* (2013.01); *H01R 13/514* (2013.01); *H01R 13/5202* (2013.01); *H01R 13/6485* (2013.01); *H01R 24/542* (2013.01); *H01R 24/562* (2013.01); *H01R 13/59* (2013.01)

(58) Field of Classification Search
USPC ..... 439/92, 188, 944; 200/51.1
See application file for complete search history.

(56) References Cited

U.S. PATENT DOCUMENTS 6,106,314 A * 8/2000 McLean ..... H01R 13/7032 200/51.1
6,636,407 B1 * 10/2003 Ryman ..... H01P 1/202 361/113
7,338,329 B2 * 3/2008 Yang ..... H01R 24/58 439/188
7,347,727 B2 3/2008 Wlos et al.
7,371,124 B2 * 5/2008 Khemakhem ..... H01P 1/045 439/668
7,416,444 B1 * 8/2008 Lin ..... H01R 13/2421 200/51.1
7,458,834 B1 * 12/2008 Chen ..... H01R 13/11 439/188
7,632,122 B2 * 12/2009 Pesant ..... H01R 24/44 439/188
7,972,173 B1 7/2011 Hyzin et al.
8,002,574 B1 8/2011 Yi
8,043,118 B1 10/2011 Lee
8,142,214 B1 * 3/2012 Huang ..... H01R 9/0521 439/188
8,172,617 B2 * 5/2012 Peng ..... H01R 24/44 439/188
8,303,323 B2 * 11/2012 Peng ..... H01R 13/7033 439/188
8,636,522 B2 * 1/2014 Sykes ..... H01R 9/0515 439/63
9,048,600 B2 6/2015 Holland
9,130,328 B1 9/2015 Huang et al.
9,716,345 B2 * 7/2017 Watkins ..... H01R 13/6581
2010/0221940 A1 * 9/2010 Hoyack ..... H01R 24/44 439/188
2011/0312199 A1 * 12/2011 Alrutz ..... H01R 13/622 439/188
2013/0115809 A1 * 5/2013 Hanson ..... H01R 13/2421 439/578
2017/0201047 A1 * 7/2017 Hanson ..... H01R 13/2421

* cited by examiner

COAXIAL CONNECTOR WITH TRANSLATING GROUNDING COLLAR FOR ESTABLISHING A GROUND PATH WITH A MATING CONNECTOR

CROSS REFERENCE TO RELATED APPLICATIONS

This application claims the benefit of priority of U.S. Provisional Application Ser. No. 62/418,308, filed Nov. 7, 2016, the content of which is relied upon and incorporated herein by reference in its entirety.

BACKGROUND

The disclosure relates generally to electrical coaxial connectors for establishing electrical connections between mated electrical connectors, and more particularly to electrical coaxial connectors with a translating grounding collar for establishing a ground path with a mating connector.

Coaxial connectors are frequently used to establish electrical connections between different electronic devices and/or electronic components to each other to establish electronic communication between them. A coaxial connector is an electrical connector typically used with coaxial cables to maintain a quality connection and shielding across the connection of coaxial components. In particular, coaxial connectors are configured to carry (e.g., propagate) electrical signals (e.g., frequency signals, radio frequency (RF) signals, microwave RF signals, etc.) across the connection of coaxial components. Some coaxial connectors are used as adapters to mate to and provide electrical communication between two other connectors that need to be mated.

Coaxial connectors conventionally include electrically conductive contacts, which are surrounded by a non-conductive insulator, such as plastic, which is then surrounded by a housing, among other components. In manufacturing and machining a coaxial connector, each of the components (e.g., parts, pieces) of the coaxial connector has a certain manufacturing tolerance or range of variability (e.g., +/−0.001 mm). When the coaxial connector is assembled, the manufacturing tolerances of each individual component attribute to a tolerance stack up or range of variability of the entire assembly. In other words, for example, the precise location of the tip of a conductor (e.g., male pin contact, female socket contact, etc.) relative to an end of the housing may vary between different coaxial connectors, even though the coaxial connectors are of the same type and manufacture. This creates some variability in the compression and/or mating distance required for these connectors to make and/or maintain electrical contact for continuous signal conductivity.

Further, these coaxial connectors conventionally require a grounding contact as part of the circuit connection made by the connector. However, electrical surges may occur as the coaxial connector is mated to another connector where an electro-static discharge (ESD) is generated across the conductors prior to grounding through the grounding contact due to a buildup of static charge in the connectors. Such an electrical surge may cause damage to electronic equipment (e.g., printed circuit board (PCB) and/or components thereof) in electrical communication with the coaxial connector. Further, without a proper ground connection, the coaxial connector may not function properly (e.g., may not provide a properly functioning RF path) and/or may experience rapid electrical degradation of the conductors of the corresponding connectors.

No admission is made that any reference cited herein constitutes prior art. Applicant expressly reserves the right to challenge the accuracy and pertinency of any cited documents.

SUMMARY

Embodiments of the disclosure are directed to a coaxial connector with a translating grounding collar for establishing a ground path with a mating connector. The coaxial connector is configured to establish a ground path and an electrical path between two mating connectors. In exemplary aspects disclosed herein, the coaxial connector includes a housing with a first conductor and a second conductor mounted within, and electrically insulated from, the housing. Further, the coaxial connector comprises a grounding collar mounted to the housing to provide a grounding path between the coaxial connector and the mating connector during mating that can discharge electrostatic discharge (ESD) build up before an electrical path is established between the first and second conductors and a mating connector. At least a portion of the first conductor is positioned in the grounding collar, with the grounding collar and first conductor independently spring-biased towards a first end of the coaxial connector. Prior to mating of the coaxial connector with a mating connector, the first and second conductors are electrically insulated from one another. As a first end of the coaxial connector is mated with a mating connector, the grounding collar is designed to make contact with the mating connector, and axially translate before the first conductor contacts the mating connector. Once the grounding collar and the first conductor are in contact with the mating connector, the grounding collar and first conductor axially translate together at least until the first conductor contacts the second conductor. Thus, the coaxial connector is grounded before establishing an electrical connection between the coaxial connector and a mating connector while also compensating for tolerance stack variability in the coaxial connector. Thus, a continuous and reliable electrical and grounding contact between the connectors can be made through the coaxial connector.

One embodiment of the disclosure relates to a coaxial connector comprising a housing, a first conductor, and a grounding collar. The housing comprises a first end and a second end. The first conductor is mounted within and electrically insulated from the housing. The grounding collar is mounted to and in electrical communication with an exterior of the housing with at least a portion of the first conductor positioned within the grounding collar. The grounding collar is biased towards the housing first end and configured to axially translate towards the housing second end upon contact with a first connector. The coaxial connector is configured to establish an electrical path between the first conductor and the first connector after establishing a grounding path between the grounding collar and the first connector, and after axial translation of the grounding collar.

An additional embodiment of the disclosure relates to a coaxial connector comprising a housing, a first conductor, a second conductor and a grounding collar. The housing comprises a first end and a second end. The first conductor comprises a first end and a second end. The first conductor first end is configured to contact a first connector. The first conductor is mounted within the housing towards the housing first end by a first dielectric. The first conductor is electrically insulated from the housing by the first dielectric. The first conductor is biased towards the housing first end and configured to axially translate towards the housing second end upon contact of the first conductor first end with the first connector. The second conductor comprises a first end and a second end. The second conductor second end is configured to contact a second connector. The second conductor is electrically insulated from the housing by a second dielectric. The second conductor is mounted within the housing towards the housing second end by the second dielectric. The second conductor is fixed relative to the housing. The grounding collar is mounted to and in electrical communication with an exterior of the housing, with at least a portion of the first conductor positioned within the grounding collar. The grounding collar is biased towards the housing first end and configured to axially translate towards the housing second end upon contact with the first connector. The coaxial connector is configured to establish an electrical path between the first conductor and the first connector after establishing a grounding path between the grounding collar and the first connector, and after axial translation of the grounding collar. The coaxial connector is further configured to establish electrical contact between the first conductor second end and the second conductor first end after axial translation of the first conductor.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1A:
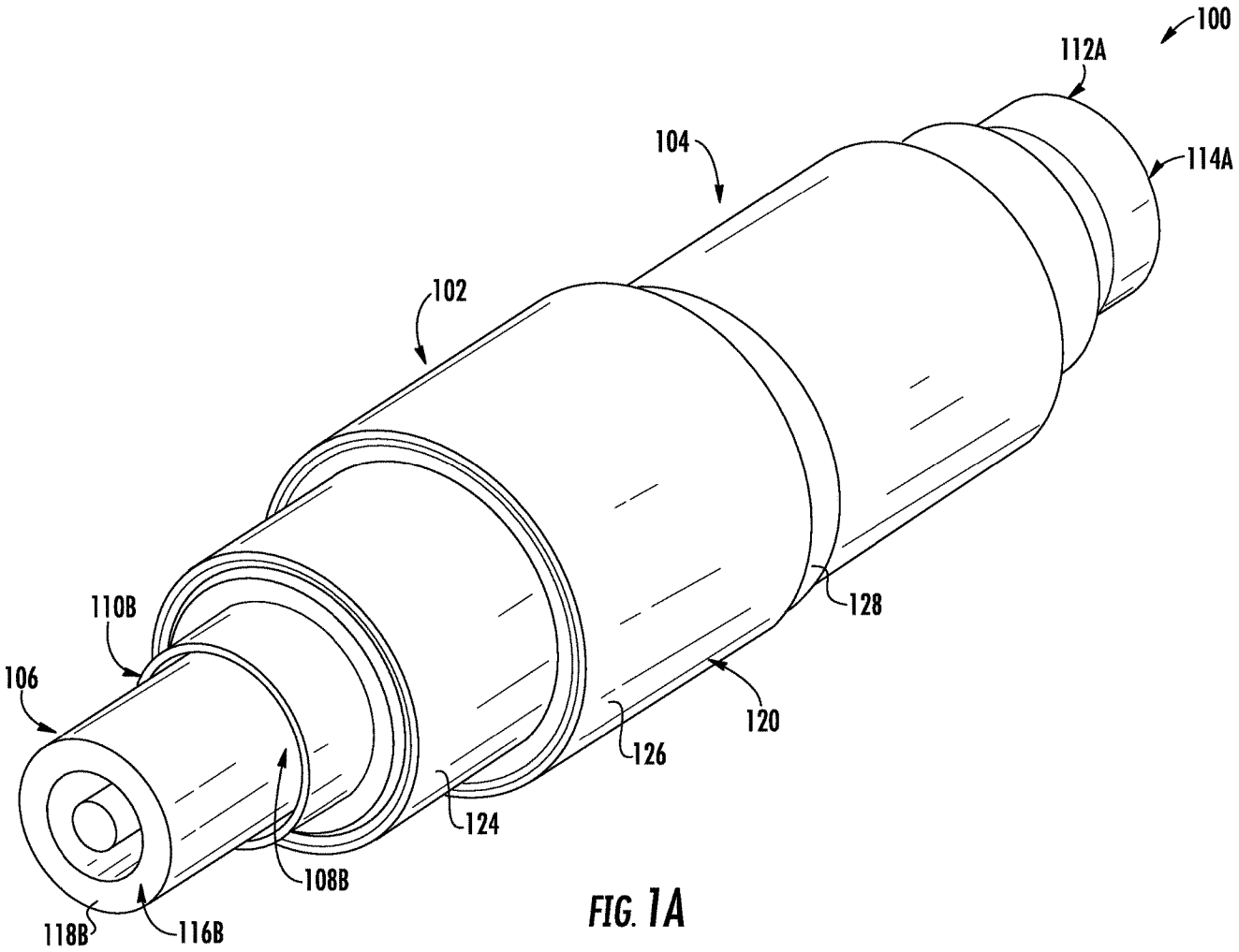
FIG. 1A is a perspective view of one embodiment of a connector subassembly illustrating an exemplary coaxial connector mated with a first mating connector and a second mating connector, wherein the coaxial connector includes a translating grounding collar to establish a ground path with the first mating connector, and wherein the coaxial connector comprises a first mating interface at a first end, a second mating interface at a second end, a housing assembly therebetween, and an electrical trace assembly mounted within the housing assembly.

Embodiments of the disclosure are directed to a coaxial connector with a translating grounding collar for establishing a ground path with a mating connector. The coaxial connector is configured to establish a ground path and an electrical path between two mating connectors. In exemplary aspects disclosed herein, the coaxial connector includes a housing with a first conductor and a second conductor mounted within, and electrically insulated from, the housing. Further, the coaxial connector comprises a grounding collar mounted to the housing to provide a grounding path between the coaxial connector and the mating connector during mating that can discharge electrostatic discharge (ESD) build up before an electrical path is established between the first and second conductors and a mating connector. At least a portion of the first conductor is positioned in the grounding collar, with the grounding collar and first conductor independently spring-biased towards a first end of the coaxial connector. Prior to mating of the coaxial connector with a mating connector, the first and second conductors are electrically insulated from one another. As a first end of the coaxial connector is mated with a mating connector, the grounding collar is designed to make contact with the mating connector, and axially translate before the first conductor contacts the mating connector. Once the grounding collar and the first conductor are in contact with the mating connector, the grounding collar and first conductor axially translate together at least until the first conductor contacts the second conductor. Thus, the coaxial connector is grounded before establishing an electrical connection between the coaxial connector and a mating connector while also compensating for tolerance stack variability in the coaxial connector. Thus, a continuous and reliable electrical and grounding contact between the connectors can be made through the coaxial connector.

FIGS. 1A-1D are views of one embodiment of a connector subassembly 100 illustrating an exemplary coaxial connector 102, a first mating connector 104, and a second mating connector 106. The coaxial connector 102 is configured to establish a ground path and an electrical path between the coaxial connector 102, the first mating connector 104, and/or the second mating connector 106. As will be discussed in more detail below, the coaxial connector 102 establishes the ground path with the first mating connector 104 before the coaxial connector 102 establishes the electrical path with the first mating connector 104 by use of one or more axially translating grounding features (discussed below in more detail). Establishing the grounding path between the coaxial connector 102 and the first mating connector 104 during mating can discharge ESD build up before an electrical path is established between the coaxial connector 102 and the first mating connector 104. Further, the coaxial connector 102 compensates for tolerance stack variability through one or more axially translating electrical features (discussed below in more detail). In this manner, as the coaxial connector 102 is mated with the first mating connector 104, the grounding feature is designed to contact the first mating connector, and axially translate before the electrical feature contacts the first mating connector 104. Thus, the coaxial connector 102 is grounded before establishing an electrical connection between the coaxial connector 102 and first mating connector 104 while also compensating for tolerance stack variability in the coaxial connector 102. Thus, a continuous and reliable electrical and grounding contact between the first mating connector 104 and second mating connector 106 can be made through the coaxial connector 102.

The coaxial connector 102 comprises a first mating interface 108A at a first end 110A for mating with the first mating connector 104 and a second mating interface 108B at a second end 110B (opposite the first end 110A) for mating with the second mating connector 106. Similarly, the first mating connector 104 comprises a first mating interface 112A at a first end 114A and a second mating interface 112B at a second end 114B (opposite the first end). The first mating connector second mating interface 112B is configured to mate with the coaxial connector first mating interface 108A. Similarly, the second mating connector 106 comprises a first mating interface 116A (shown in FIG. 4A) at a first end 118A (shown in FIG. 4A) and a second mating interface 116B at a second end 118B (opposite the first end 118A). The second mating connector first mating interface 116A is configured to mate with the coaxial connector second mating interface 108B. In certain embodiments the second mating connector 106 comprises an SMPM connector (e.g., GPPO connector). For example, the second mating connector first mating interface 116A can comprise an SMPM female connector interface (e.g., socket) and the coaxial connector second mating interface 108B can comprise an SMPM male connector interface (e.g., pin).

Figure 1B:
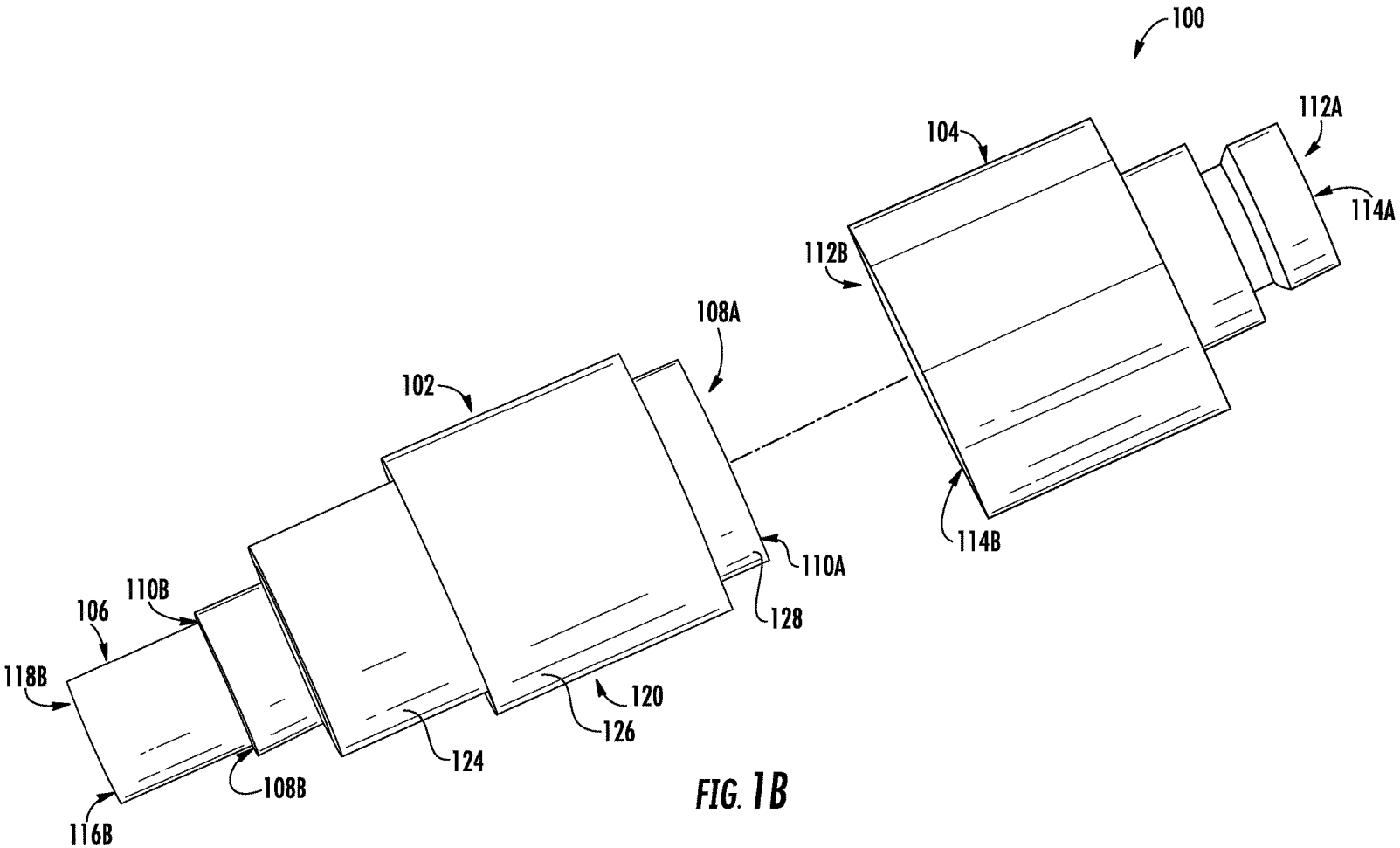
FIG. 1B is a side view of the coaxial connector and first mating connector of FIG. 1A separated from one another.
Figure 1C:
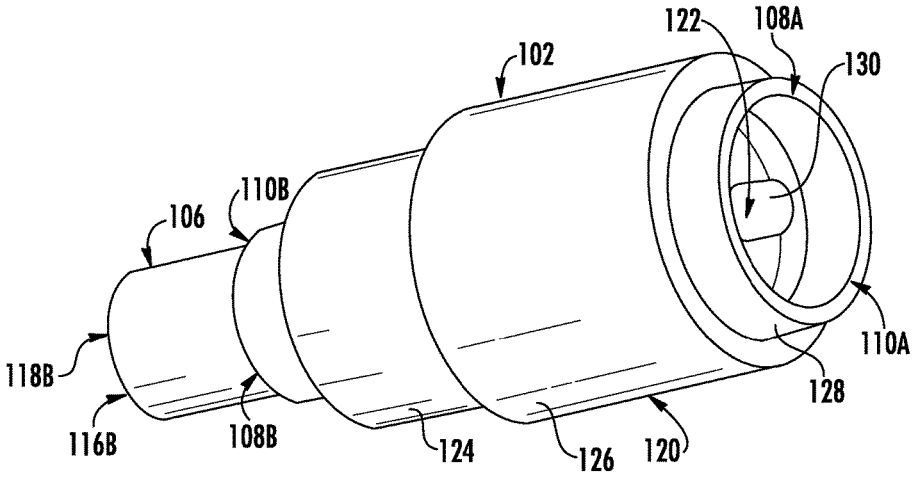
FIG. 1C is a perspective view of the first mating interface of the coaxial connector of FIG. 1A.
Figure 1D:
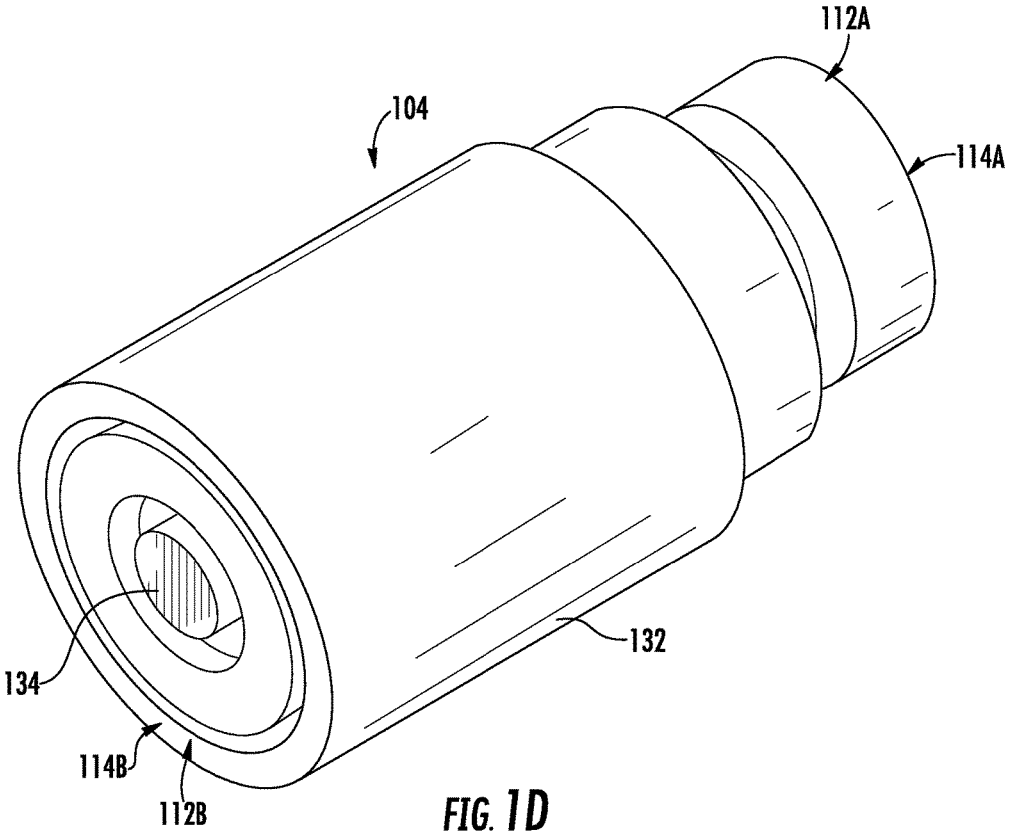
FIG. 1D is a perspective view of a first mating interface of the first mating connector of FIG. 1A.

FIG. 1A is a perspective view of the coaxial connector 102 mated with the first mating connector 104, and in particular, the coaxial connector first mating interface 108A mated with the first mating connector second mating interface 112B. Also shown, is the coaxial connector 102 mated with the second mating connector 106, and in particular, the coaxial connector second mating interface 108B connected with the second mating connector first mating interface 116A. FIGS. 1B-1D are views of the coaxial connector 102 disconnected from the first mating connector 104, and in particular, the coaxial connector first mating interface 108A disconnected from the first mating connector second mating interface 116B. Also shown, is the coaxial connector 102 mated with the second mating connector 106, and in particular, the coaxial connector second mating interface 108B connected with the second mating connector first mating interface 116A.

As shown in FIGS. 1A-1C, the coaxial connector 102 comprises a housing assembly 120 (e.g., shroud assembly, etc.) and an electrical trace assembly 122 housed within the housing assembly 120. The housing assembly 120 comprises a housing 124, an outer shell 126, and a grounding collar 128 (e.g., grounding feature) positioned therebetween. The outer shell 126 maintains attachment of the grounding collar 128 to the housing 124. The grounding collar 128 is mounted to, and in electrical communication with, the housing 124 to provide a grounding path between the coaxial connector 102 and the first mating connector 104 during mating that can discharge electro-static discharge (ESD) build up before an electrical path is established between the first conductor 130 (e.g., electrical feature) and first mating connector 104. The grounding collar 128 is biased towards the coaxial connector first end 110A and coaxial connector first end 110A (e.g., by a spring). Further, the grounding collar 128 is axially translatable (e.g., movable) relative to the housing 124 and is configured to axially translate towards the coaxial connector second end 110B upon contact with the first mating connector 104. This axial translation allows the coaxial connector 102 to establish an electrical path with the first mating connector 104 after a grounding path has been established to discharge ESD build up before an electrical path is established, thereby protecting electrically connected equipment from an electrical surge and potential corresponding damage.

As shown in FIG. 1C, the electrical trace assembly 122 comprises a first conductor 130 positioned within the housing 124 towards the coaxial connector first end 110A (forming a part of the coaxial connector first mating interface 108A). A portion of the first conductor 130 is positioned within the grounding collar 128 (explained in more detail below). The first conductor 130 is mounted within, and electrically insulated from, the housing 124. The first conductor 130 is configured to form an electrical path with the first mating connector 104 when the first conductor 130 contacts the first mating connector 104.

As shown in FIG. 1D, the first mating connector 104 comprises a housing 132 and a conductor 134 positioned within the housing 132. The coaxial connector first mating interface 108A and first mating connector first mating interface 112A are complementary configured such that the coaxial connector 102 and first mating connector 104 establish a ground path (e.g., grounding connection) before the coaxial connector 102 and first mating connector 104 establish an electrical path (e.g., signal path). More specifically, the coaxial connector grounding collar 128 is configured to contact the first mating connector housing 132 to establish a grounding path from the coaxial connector 102 to the first mating connector 104. In this manner, an end surface of the first mating connector housing 132 is planar with an end surface of the first mating connector conductor 134, whereas an end surface of the coaxial connector grounding collar 128 extends past an end surface of the coaxial connector first conductor 130, thereby ensuring that the grounding collar 128 contacts the first mating connector housing 132 before the coaxial connector first conductor 130 contacts the first mating connector conductor 134. However, other configurations are possible (e.g., where the end surface of the first mating connector housing 132 is non-planar with the end surface of the first mating connector conductor 134).

Upon contact with the first mating connector housing 132, the grounding collar 128 translates towards the coaxial connector second end 110B. After the grounding collar 128 translates, the coaxial connector first conductor 130 contacts the first mating connector conductor 134 to establish an electrical path between the coaxial connector 102 and the first mating connector 104. Thus, the coaxial connector 102 is grounded before establishing an electrical connection between the coaxial connector 102 and the first mating connector 104 (and the second mating connector 106). Thus, a continuous and reliable electrical and grounding contact between the connectors 102, 104, 106 can be made through the coaxial connector 102.

Figure 2:
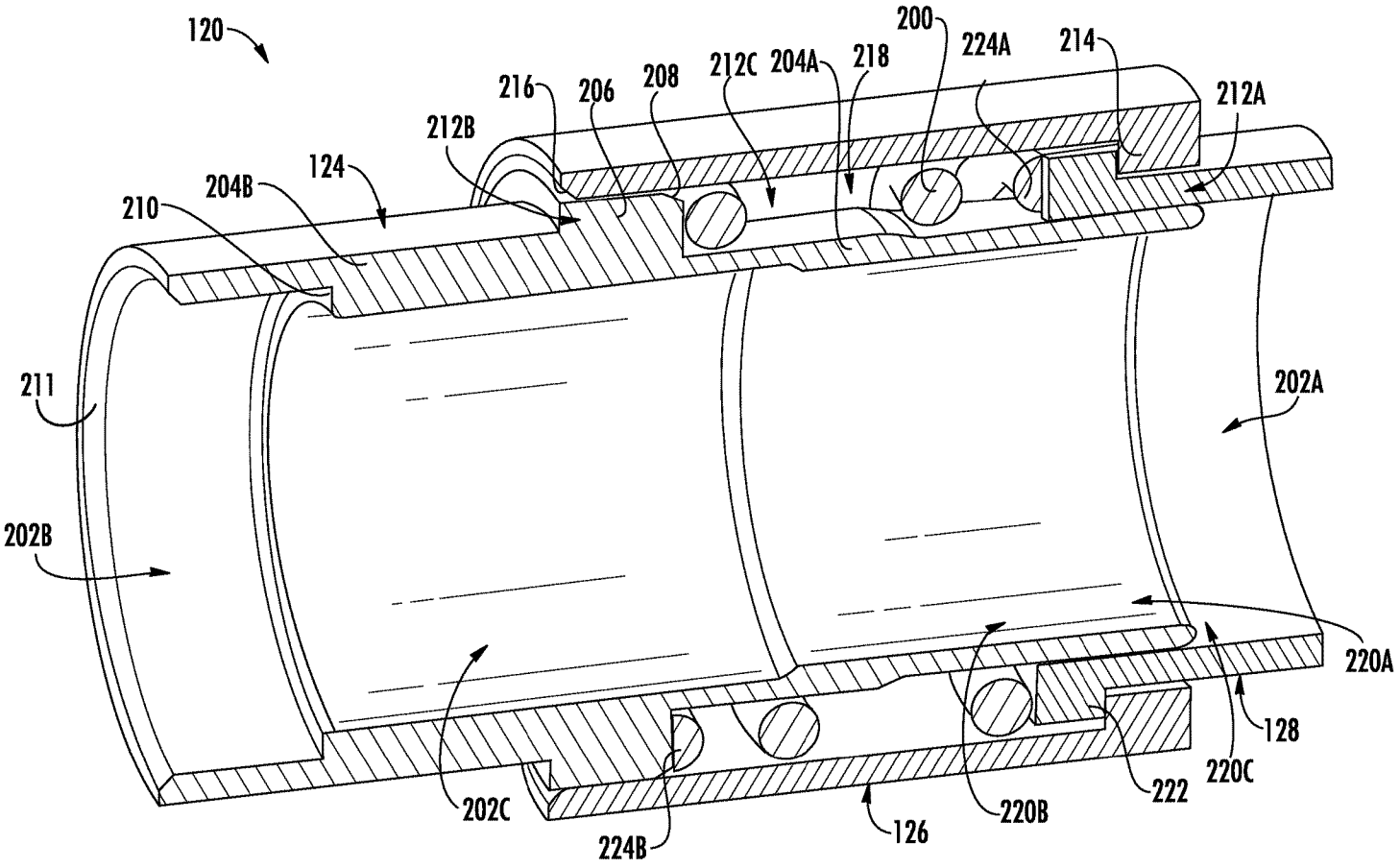
FIG. 2 is a cross-sectional perspective view of the housing assembly of the coaxial connector of FIGS. 1A-1D.

FIG. 2 is a cross-sectional perspective view of the housing assembly 120 of the coaxial connector 102 of FIGS. 1A-1D. As shown, the housing assembly 120 contains the electrical trace assembly 122 and establishes a grounding path with the first mating connector 104. The housing assembly 120 comprises the housing 124, the outer shell 126, the grounding collar 128, and an outer spring 200 (e.g., first spring). The housing 124 contains the electrical trace assembly 122, is generally cylindrical, and defines a first opening 202A at a first end (towards the coaxial connector first end 110A), a second opening 202B at a second end (opposite the first end and towards the coaxial connector second end 110B), and a generally cylindrical interior 202C therebetween. The housing 124 further comprises a first portion 204A towards the first opening 202A, a second portion 204B towards the second opening 202B, and an outer shoulder 206 outwardly extending (e.g., generally perpendicularly) from an external surface of the housing 124 between the first portion 204A and second portion 204B. The outer shoulder 206 may comprise a chamfer 208 towards the first opening 202A to facilitate assembly of the outer shell 126 to the housing 124 (explained in more detail below). The second portion 204B may comprise an inner shoulder 210 positioned between an end of the second portion 204B and the outer shoulder 206. The inner shoulder 210 provides a mounting surface for the electrical trace assembly 122 (explained below in more detail). Further, the second opening 202B may include an inner chamfer 211 along an interior edge of the rim to facilitate assembly of the electrical trace assembly 122 within the housing interior 202C.

The outer shell 126 maintains attachment of the grounding collar 128 to the housing 124, is generally cylindrical, and defines a first opening 212A at a first end (e.g., towards the coaxial connector first end 110A), a second opening 212B at a second end (opposite the first end and towards the coaxial connector second end 110B), and a generally cylindrical interior 212C therebetween. The outer shell 126 further comprises an inward annular flange 214 proximate the first end and defining the first opening 212A to maintain attachment of the grounding collar 128 to the housing 124. In this manner, the size (e.g., diameter) of the first opening 212A is smaller than the second opening 212B. An interior surface of the outer shell 126 (towards the second opening 212B is frictionally engaged with an exterior surface of the housing outer shoulder 206. Accordingly, the outer shell 126 is fixedly attached to the housing 124 and defines a gap 218 (e.g., gap region, divide, etc.) between the outer shell 126 and the housing first portion 204A to retain a portion of the grounding collar 128 within the gap 218. Further, the second opening 212B may include an inner chamfer 216 along an interior edge of the rim to facilitate assembly of the outer shell 126 to the grounding collar 128. More specifically, the outer shell inner chamfer 216 interacts with the housing outer shoulder chamfer 208 to facilitate the assembly as the outer shoulder 206 is slid into the outer shell second opening 212B.

The grounding collar 128 establishes a grounding path with the first mating connector 104, is generally cylindrical, and defines a first opening 220A at a first end (e.g., towards the coaxial connector first end 110A), a second opening 220B at a second end (opposite the first end and towards the coaxial connector second end 110B), and a generally cylindrical interior 220C therebetween. The grounding collar 128 further comprises an outward annular flange 222 proximate the second opening 220B first end to maintain attachment of the grounding collar 128 to the housing 124. When assembled, as shown, a portion of the housing 124 (e.g., the housing first opening 202A) is positioned within the grounding collar interior 220C, with the grounding collar outward annular flange 222 positioned within the gap 218. In this manner, the grounding collar 128 is axially translatable relative to the housing 124 where the grounding collar outward annular flange 222 has clearance for translating within the gap 218. However, the grounding collar 128 is prevented from disengaging from the housing 124 and grounding collar 128 by the interaction of the grounding collar outward annular flange 222 with the outer shell inward annular flange 214. In other words, the outer shell first opening 212A is larger than an external diameter of the grounding collar 128 (e.g., proximate the grounding collar first opening 220A) but smaller than an external diameter of the grounding collar outward annular flange 222. In this manner, the grounding collar 128 cannot disengage from the housing 124.

The outer spring 200 biases the grounding collar 128 relative to the housing 124 towards the coaxial connector first end 110A, and comprises a first flat end surface 224A at a first end and a second flat end surface 224B at a second end (opposite the first end). As shown, the outer spring 200 is positioned within the gap 218 with the first flat end surface 224A positioned towards the coaxial connector first end 110A and contacting the grounding collar 128 (proximate the grounding collar second opening 220B). The second flat end surface 224B is positioned towards the coaxial connector second end 110B and contacting the housing outer shoulder 206. In this manner, the outer spring 200 biases the grounding collar 128 towards the coaxial connector first end 110A, but is compressible such that the grounding collar 128 can axially translate within the gap 218. Further, the outer spring 200 provides continuous grounding contact between the grounding collar 128 and the housing outer shoulder 206. The first and second flat end surfaces 224A, 224B help facilitate an even, constant contact between the grounding collar 128 and the housing outer shoulder 206, minimizes the length of the outer spring 200, provides a lower solid height of the outer spring 200, and spreads out the biasing force.

Figure 3:
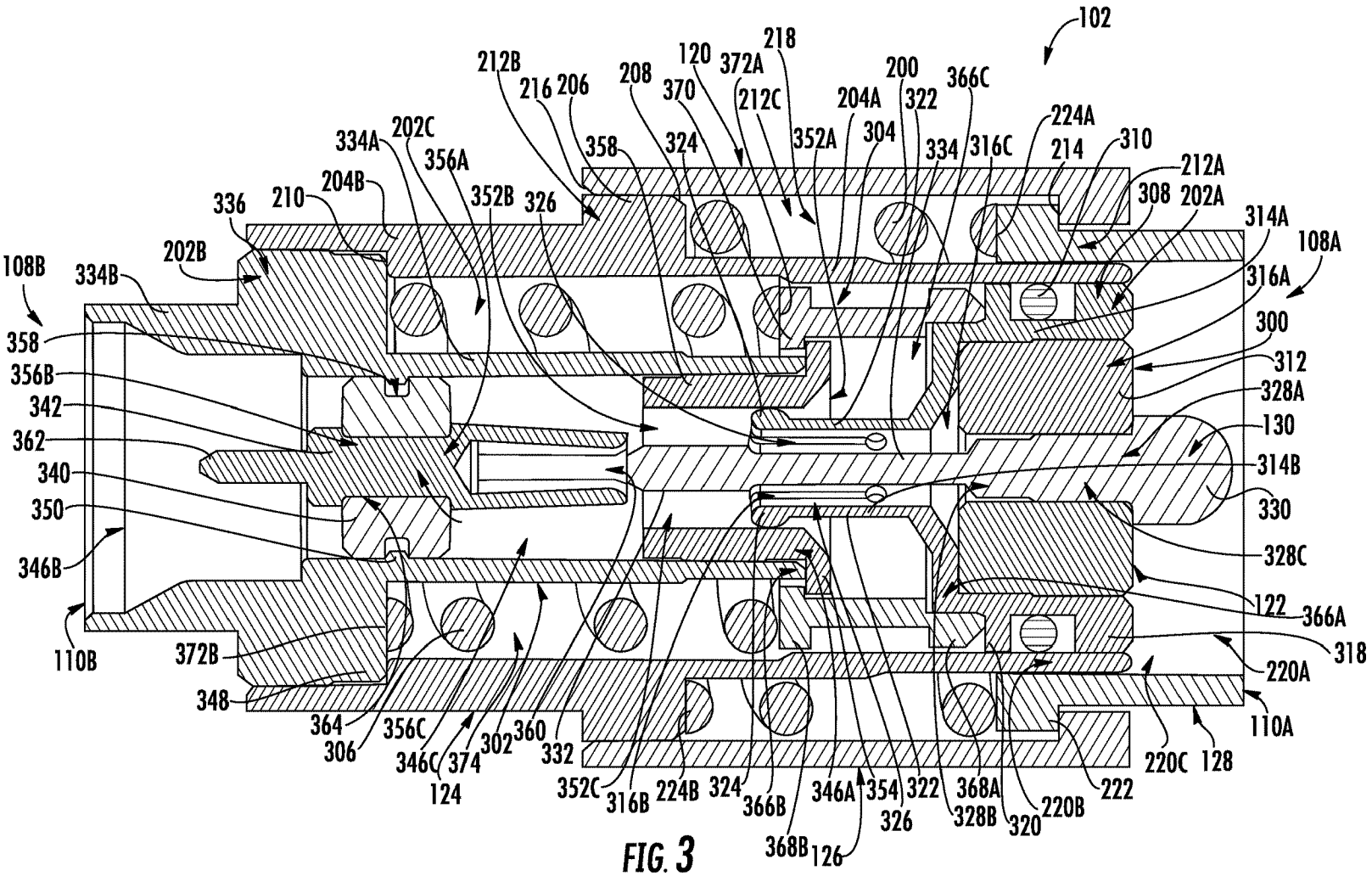
FIG. 3 is a cross-sectional side view of the coaxial connector of FIGS. 1A-1D, illustrating assembly of the housing assembly with the electrical trace assembly, wherein the housing assembly comprises a housing and the grounding collar, and the electrical trace assembly comprises a first conductor and a second conductor mounted within the housing and separated from one another.

FIG. 3 is a cross-sectional side view of the coaxial connector 102 of FIGS. 1A-1D, illustrating assembly of the housing assembly 120 with the electrical trace assembly 122. The electrical trace assembly 122 establishes an electrical path from the first mating connector 104 through the coaxial connector 102 to the second mating connector 106. The electrical trace assembly 122 comprises a first conductor subassembly 300, a second conductor subassembly 302, an intermediate bushing 304, and an inner spring 228 (e.g., second spring). The first conductor assembly 300 is positioned towards the coaxial connector first end 110A (e.g., proximate and/or within the housing first opening 202A), and the second conductor subassembly 302 is positioned towards the coaxial connector second end 110B (e.g., proximate and/or within the housing second opening 202B). The first conductor subassembly 300 and second conductor subassembly 302 are connected to one another by the intermediate bushing 304, and axially biased from one another by an inner spring 306. The first conductor subassembly 300 and second conductor subassembly 302 interact with each other to establish an electrical path therebetween (explained below in more detail).

Each of the first conductor subassembly 300 and second conductor subassembly 302 is mounted within and electrically insulated from the housing 124, and electrically insulated from each other when disconnected from the first mating connector 104 (explained in more detail below). The first conductor subassembly 300 and second conductor subassembly 302 are configured to form an electrical path with the first mating connector 104 when the first conductor subassembly 300 contacts the first mating connector 104. More specifically, the first conductor subassembly 300 is configured to axially translate towards the second conductor subassembly 302 (e.g., and towards the coaxial connector second end 110B) to make contact with the second conductor subassembly 302 and establish an electrical path between the coaxial connector 102 and the first mating connector 104. Axial translation of the first conductor subassembly 300 ensures that the grounding path is established before the electrical path and also compensates for tolerance stack variability.

The first conductor subassembly 300 comprises a first conductor housing 308, an O-ring 310 (e.g., gasket) positioned external to the first conductor housing 308, a first conductor dielectric cylinder 312 positioned within the first conductor housing 308, and the first conductor 130 mounted within the first conductor dielectric cylinder 312. The first conductor housing 308 is in grounding connection with the housing assembly 120. The O-ring 310 seals the housing assembly housing 124 from the environment and ensures proper operation and functioning of the coaxial connector 102. The first conductor dielectric cylinder 312 mounts the first conductor 130 within the first conductor housing 308 and electrically insulates the first conductor 130 from the first conductor housing 308.

The first conductor housing 308 mounts the first conductor 130 within the housing assembly 120. The first conductor housing 308 is in grounding connection with the housing assembly 120. The first conductor housing 308 comprises a first portion 314A defining a first opening 316A at a first end (e.g., towards the coaxial connector first end 110A), a second portion 314B defining a second opening 316B at a second end (e.g., opposite the first end and towards the coaxial connector second end 110B), and an interior 316C positioned between the first opening 316A and the second opening 316B. The first conductor housing first portion 314A frictionally engages the first conductor dielectric cylinder 312 to fixedly mount the first conductor dielectric cylinder 312 within the interior 316C. The first portion 314A comprises an outer annular flange 318 proximate the first opening 316A, and an outer annular protrusion 320 positioned between the outer annular flange 318 and the second cylindrical portion 314B to retain the O-ring 310. The O-ring 310 is positioned and retained between the outer annular flange 318 and outer annular protrusion 320 and remains therebetween as the first conductor housing 308 axially translates relative to the housing assembly housing 124. The second cylindrical portion 314B comprises a plurality of axial cantilever strips 322 extending towards the coaxial connector second end 110B, with each of the axial cantilever strips 322 outwardly biased and comprising a bulbous end 324 to maintain contact with the intermediate bushing 304 and maintain contact as the first conductor housing 308 axially translates relative to the intermediate bushing 304. The axial cantilever strips 322 are circumferentially positioned and separated from one another by axially extending channels 326.

The first conductor dielectric cylinder 312 mounts the first conductor 130 within the first conductor housing 308 and electrically insulates the first conductor 130 from the first conductor housing 308. The first conductor dielectric cylinder 312 is generally cylindrical and defines a first opening 328A at a first end (towards the coaxial connector first end 110A), a second opening 328B at a second end (opposite the first end and towards the coaxial connector second end 110B), and a generally cylindrical interior 328C therebetween. As shown, the first conductor dielectric cylinder 312 mounts the first conductor 130 within the interior 328C.

The first conductor 130 comprises a first male hemispherical contact 330 at a first end, a second male cylindrical contact 332 at a second end, and a rod 334 therebetween. As shown, the first male hemispherical contact 330 is configured to contact the first mating connector 104 (and establish an electrical path therebetween). The first male hemispherical contact 330 is positioned towards the coaxial connector first end 110A, within the grounding collar 128 (e.g., within the grounding collar interior 220C), but exterior to the housing assembly housing 124, the first conductor housing 308 (e.g., first conductor housing first portion 314A), and/or the first conductor dielectric cylinder 312. It is noted that the coaxial connector 102 is configured to minimize the distance between the grounding collar 128 and the electrical signal path (e.g., first conductor 130). This increases the operational reliability of the coaxial connector 102 when mated with the first mating connector 104.

The first conductor 130 is configured to contact and mate with the first mating connector 104. The position of the first male hemispherical contact 330 allows the grounding collar 128 to establish a grounding path before the first male hemispherical contact 330 establishes an electrical path, but also provides a point of electrical contact after the grounding collar 128 axially translates relative to the housing assembly housing 120 and/or first male hemispherical contact 330.

The rod 334 extends through the first conductor housing 308 (e.g., through the first conductor dielectric cylinder 312) without contacting the first conductor housing 308. This ensures that the first conductor 130 does not contact the first conductor housing 308 and insulates the grounding path from the electrical path. As shown, the second male cylindrical contact 332 extends past the first conductor housing second opening 316B, and is positioned within the intermediate bushing 304, proximate to the second conductor subassembly 302. This gap electrically insulates the first conductor subassembly 300 from the second conductor subassembly 302 when the first conductor 130 is in an uncompressed orientation.

The second conductor subassembly 300 comprises a second conductor housing 336, a second conductor bushing 338, a second conductor dielectric cylinder 340, and a second conductor 342 (e.g., electrical feature). The second conductor housing 336 mounts the second conductor 342 within the housing assembly 120. The second conductor housing 336 is in grounding connection with the housing assembly 120. The second conductor bushing 338 attaches the second conductor subassembly 302 to the intermediate bushing 304 (and prevents disengagement of the first conductor subassembly 300 from the housing assembly 120). The second conductor dielectric cylinder 340 mounts the second conductor 342 within the second conductor housing 336 and electrically insulates the second conductor 342 from the second conductor housing 336.

The second conductor housing comprises a first portion 344A defining a first opening 346A at a first end (e.g., towards the coaxial connector first end 110A), a second portion 344B defining a second opening 346B at a second end (e.g., opposite the first end and towards the coaxial connector second end 110B), an interior 346C positioned between the first opening 346A and the second opening 346B, and an outer shoulder 348 positioned between the first portion 344A and the second portion 344B. The outer shoulder 348 is positioned within the housing second opening 202B and frictionally engaged with the housing assembly housing 124, thereby fixedly attaching the second conductor housing 336 to the housing assembly housing 124. Further the second conductor housing 336 contacts the housing second portion inner shoulder 210, which provides a stopping point when inserting the second conductor housing 336 into the housing assembly housing 124 (e.g., preventing over insertion). The first portion 344A comprises an inner annular protrusion 350 to engage and mount the second conductor dielectric cylinder 340 to the second conductor housing 336.

The second conductor bushing 338 defines a first opening 352A at a first end (towards the coaxial connector first end 110A), a second opening 352B at a second end (opposite the first end and towards the coaxial connector second end 110B), and a generally cylindrical interior 352C therebetween. The second conductor bushing 338 further comprises an outer annular flange 354 proximate the first opening 352A, which extends past an external surface of the second conductor housing 336 to interact with the intermediate bushing 304. In this manner, the outer annular flange 354 attaches the second conductor housing 336 to the intermediate bushing 304 (and prevents disengagement of the first conductor subassembly 300 from the housing assembly 120). As shown, the second conductor bushing 338 (e.g., the second opening 352B) is inserted in the second conductor housing interior 346C, and the second conductor bushing 338 is frictionally engaged with an interior surface of the second conductor housing 336 thereby fixedly attaching the second conductor bushing 338 with the second conductor housing 336.

The second conductor dielectric cylinder 340 mounts the second conductor 342 within the second conductor housing 336 and electrically insulates the second conductor 342 from the second conductor housing 336. The second conductor dielectric cylinder 340 is generally cylindrical and defines a first opening 356A at a first end (towards the coaxial connector first end 110A), a second opening 356B at a second end (opposite the first end and towards the coaxial connector second end 110B), and a generally cylindrical interior 356C therebetween. The second conductor dielectric cylinder 340 further comprises an outer annular groove 358 which receives the second conductor housing inner annular protrusion 350 therein to fixedly attach the second conductor dielectric cylinder 340 to the second conductor housing 336. As shown, the second conductor dielectric cylinder 340 mounts the second conductor 342 therein, and electrically insulates the second conductor 342 from the second conductor housing 336.

The second conductor 342 comprises a female socket contact 360 at a first end (towards the coaxial connector first end 110A), a male contact 362 at a second end (opposite the first end and towards the coaxial connector second end 110B), and an external mounting recess 364 positioned therebetween. The second conductor 342 is axially aligned with the first conductor 130. The female socket contact 360 is configured to mate with and receive the first conductor second male cylindrical contact 332 therein when the first conductor 130 axially translates towards the second conductor 342. Further, the female socket contact 360 could include tapered inner sidewalls to provide a tight fit with the first conductor second male cylindrical contact 332. The second conductor male contact 362 is configured to contact and mate with the second mating connector 106. The second conductor mounting recess 364 is configured to be positioned within the second conductor dielectric cylinder interior 356 to fixedly attach the second conductor 342 relative to the second conductor dielectric cylinder 340.

As mentioned above, the first conductor subassembly 300 is attached to the second conductor subassembly 302 by the intermediate bushing 304. The intermediate bushing 304 defines a first opening 366A at a first end (towards the coaxial connector first end 110A), a second opening 366B at a second end (opposite the first end and towards the coaxial connector second end 110B), and a generally cylindrical interior 366C therebetween. The intermediate bushing 304 comprises a first outer annular flange 368A proximate the first opening 366A at the first end and a second outer annular flange 368B proximate the second opening 366B at the second end. The first and second outer annular flanges 368A, 368B decrease the surface area contact between the intermediate bushing 304 and the inner surface of the housing assembly housing 124. This decreases the resistance force as the first conductor subassembly 300 axially translates relative to the housing assembly housing 124. The intermediate bushing 304 further comprises an inner annular flange 370 proximate the second opening 366B at the second end, which interacts with the second conductor bushing 338 to attach the first conductor subassembly 300 to the second conductor subassembly 302 and prevent disengagement of the first conductor subassembly 300 from the housing assembly housing 124.

The first conductor housing first portion 314A is positioned within the intermediate bushing first opening 366A, thereby frictionally and fixedly attaching the first conductor subassembly 300 to the intermediate bushing 304. The second conductor bushing outer annular flange 354 is positioned within the intermediate bushing interior 366C. The outer diameter of the second conductor bushing outer annular flange 354 is smaller than the interior diameter of the intermediate bushing 304 but larger than the intermediate bushing inner annular flange 370. Further, the second conductor housing first portion 344A is positioned within the intermediate bushing second opening 366B (e.g., the diameter of the intermediate bushing inner annular flange 370 is larger than the diameter of the intermediate bushing second opening 366B). In this manner, the second conductor subassembly 302 is attached to the intermediate bushing 304 but allows axial translation of the second conductor subassembly 302 relative to the intermediate bushing 304 and first conductor subassembly 300.

The inner spring 306 biases the first conductor subassembly 300 towards the coaxial connector first end 110A. The inner spring 306 comprises a first flat end surface 372A at a first end and a second flat end surface 372B at a second end (opposite the first end). The inner spring 306 is positioned within a gap 374 defined between the outer surface of the second conductor housing first portion 344A and the inner surface of the housing assembly housing 124. The inner spring 306 is axially aligned with the outer spring 200 but has a smaller diameter so that they can overlap (e.g., a portion of the inner spring 306 can be nested in a portion of the outer spring 200), which can decrease the length of the coaxial connector 102. The first flat end surface 372A contacts the second end of the intermediate bushing 304 proximate the second opening 366B. The second flat end surface 372B contacts the second conductor housing outer shoulder 348. In this manner, the inner spring 306 biases the first conductor subassembly 300 towards the coaxial connector first end 110A, but is compressible such that the first conductor subassembly 300 axially translates within the gap 374 (towards the coaxial connector second end 110B). Further, the inner spring 306 provides continuous grounding contact between the intermediate bushing 304 and the second conductor housing outer shoulder 348. The first and second flat end surfaces 372A, 372B help facilitate an even constant contact between the intermediate bushing 304 and the second conductor housing outer shoulder 348, minimizes the length of the inner spring 306, provide a lower solid height of the outer spring 200, and spread out the biasing force.

In this manner, the first conductor 130 and grounding collar 128 are independently biased (e.g., spring-biased) towards the coaxial connector first end 110A to establish the grounding path before the electrical path (explained in more detail below) and to compensate for tolerance stack variability in the coaxial connector 102. In particular, during manufacturing, each component of the coaxial connector 102 has a certain tolerance (e.g., variability) despite being of the same make and manufacture. Accordingly, the coaxial connector 102 as a whole includes tolerance stack variability where each of these component tolerances compound. As a result, for coaxial connectors 102 of the same make and manufacture, there can be variability of an end of the first conductor 130 (e.g., first male hemispherical contact 330) relative to an end of the grounding collar 128. Axial translation of the first conductor 130 allows for the coaxial connector 102 to compensate for this variability when making a connection between the coaxial connector 102 and the first mating connector 104.

FIGS. 4A-4D are views of the coaxial connector 102 mating with the first mating connector 104 to form the assembled connector assembly 100, and establishing a grounding path and electrical path from the first mating connector 104 to the second mating connector 106 through the coaxial connector 102. Alignment and mating of this particular first mating connector 104 with the coaxial connector 102 could be the result of an environmental structure. For example, coaxial connector 102 may be positioned in a first half of a clamshell device, and the first mating connector 104 may be positioned in a second half of a clamshell device, such that their positioning within the clamshell device aligns the coaxial connector 102 with the first mating connector 104. Accordingly, closing the clamshell device mates the coaxial connector 102 with the first mating connector 104.

The first mating connector 104 comprises the housing 132, a dielectric 400 positioned within the housing 132, the first conductor 130 positioned within the dielectric 400, and an insulator 402. The housing 132 comprises a first opening 404A at a first end (towards a first mating interface 112A), a second opening 404B at a second end (opposite the first end and towards the second mating interface 112B), and an interior 404C therebetween. The dielectric 400 comprises a first opening 406A at a first end (towards a first mating interface 112A), a second opening 406B at a second end (opposite the first end and towards the second mating interface 112B), and an interior 406C therebetween. Further, the dielectric 400 comprises a recess 408 at the second end (proximate the second opening 406B). The conductor 134 comprises a first male contact 410A at a first end (towards the first mating interface 112A) and a second male contact 410B at a second end (opposite from the first end and towards the second mating interface 112B). The second male contact 410B sits within the recess 408 such that an end surface of the second male contact 410B is approximately planar with an end surface of the first mating connector housing 132. Of course, other configurations could be used, and the relative positioning of the grounding collar 128 and first conductor 130 could be correspondingly altered. The insulator 402 is positioned towards the first mating interface 112A, partially positioned within the dielectric 400, and the conductor 134 extends through the insulator 402.

Figure 4A:
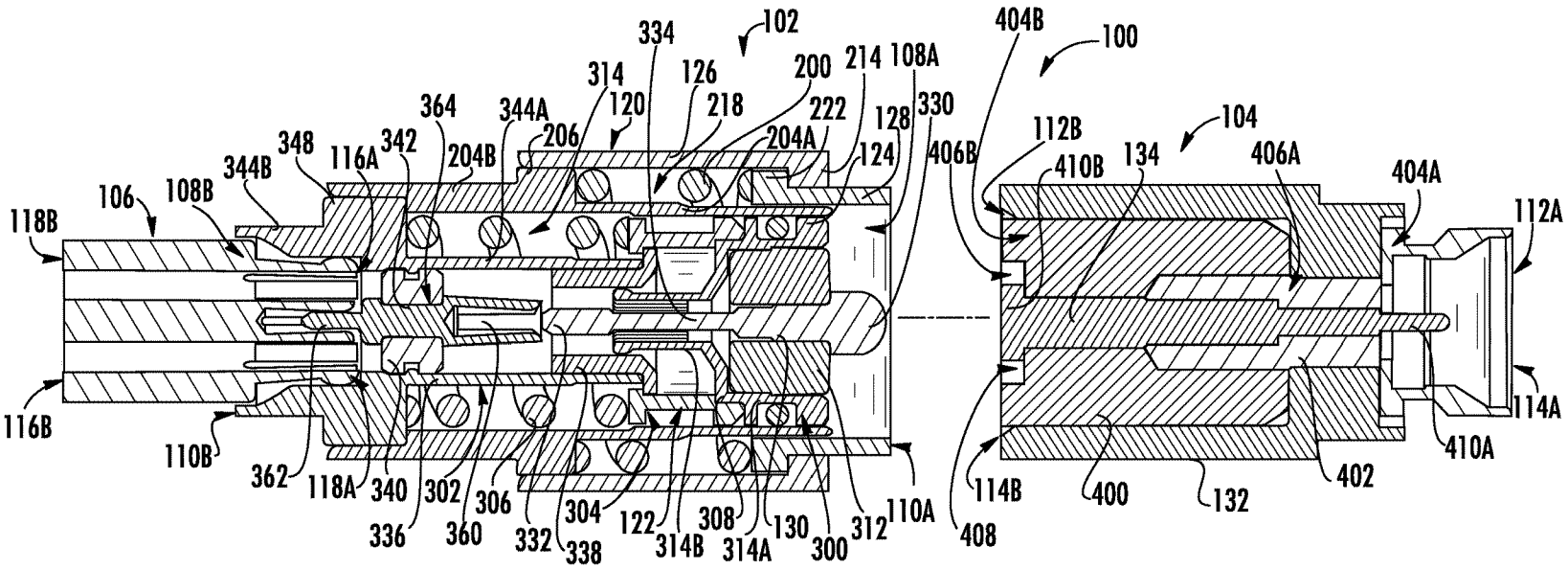
FIG. 4A is a cross-sectional side view of the coaxial connector of FIGS. 1A-3 illustrating the coaxial connector second mating interface engaged with a second mating connector, and the coaxial connector first mating interface disengaged from the first mating connector of FIGS. 1A-1D.

In FIG. 4A, the coaxial connector second mating interface 108B is engaged with the second mating connector 106 and the coaxial connector first mating interface 108A is disengaged from the first mating connector 104. In an unmated orientation (e.g., uncompressed orientation), the end surface of the grounding collar 128 of the coaxial connector 102 extends past the end surface of the first conductor first male hemispherical contact 330. The coaxial connector 102 is configured to minimize the distance that the end surface of the grounding collar 128 extends past the first conductor first male hemispherical contact 330 in an uncompressed orientation. This reduces the distance necessary for the grounding collar 128 to axially translate for the first conductor 130 to contact the first mating connector 104. Accordingly, this reduces the risk of the outer spring 200 setting (and not springing back), and it reduces the spring compression and related stress on the spring 200. Further, in the uncompressed orientation, the first conductor second male cylindrical contact 332 is separated and unmated with the second conductor female socket contact 360.

Figure 4B:
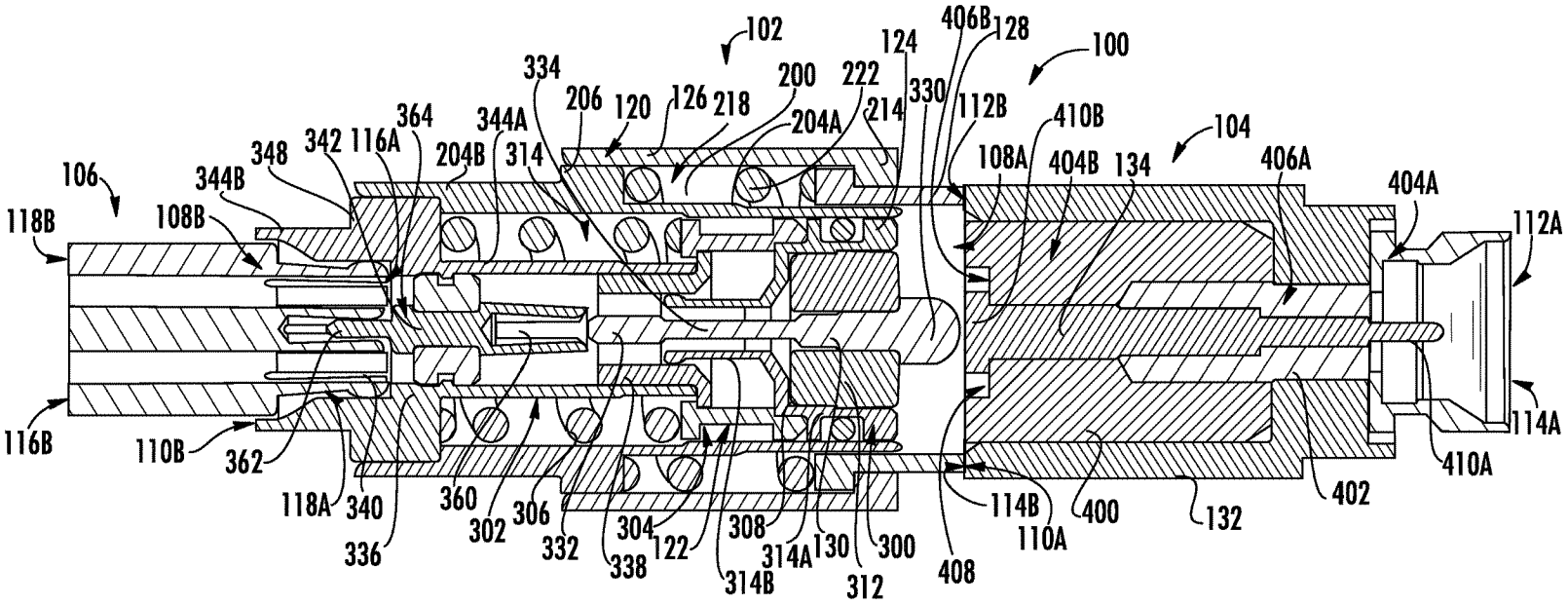
FIG. 4B is a cross-sectional side view of the coaxial connector of FIG. 4A illustrating initial contact of the coaxial connector grounding collar with the first mating connector and a separation between the first conductor and the first mating connector.

In FIG. 4B, the coaxial connector grounding collar 128 initially contacts the first mating connector housing 132 establishing a grounding path between the first mating connector 104 and the coaxial connector 102. When initially mated in this way, the grounding collar 128 remains in an uncompressed orientation (e.g., has not axially translated), and the end surface of the grounding collar 128 of the coaxial connector 102 continues to extend past the end surface of the first conductor first male hemispherical contact 330. In other words, the first conductor 130 has not contacted the first mating connector conductor 134. Accordingly, the grounding path is established before an electrical path. However, the first conductor 130 remains separated from the second conductor 342 as a precaution. More specifically, if an electrical charge (e.g., electrical arc)

should cross the air gap from the first mating connector conductor 134 to the coaxial connector first conductor 130 before the grounding collar 128 contacts the first mating connector 104 and establishes a grounding path, the separation of the first conductor 130 from the second conductor 342 ensures that the electrical surge does not extend past the first conductor 130. This protects any electronic equipment in electrical communication with the coaxial connector 102 from an electrical surge and potential damage.

Figure 4C:
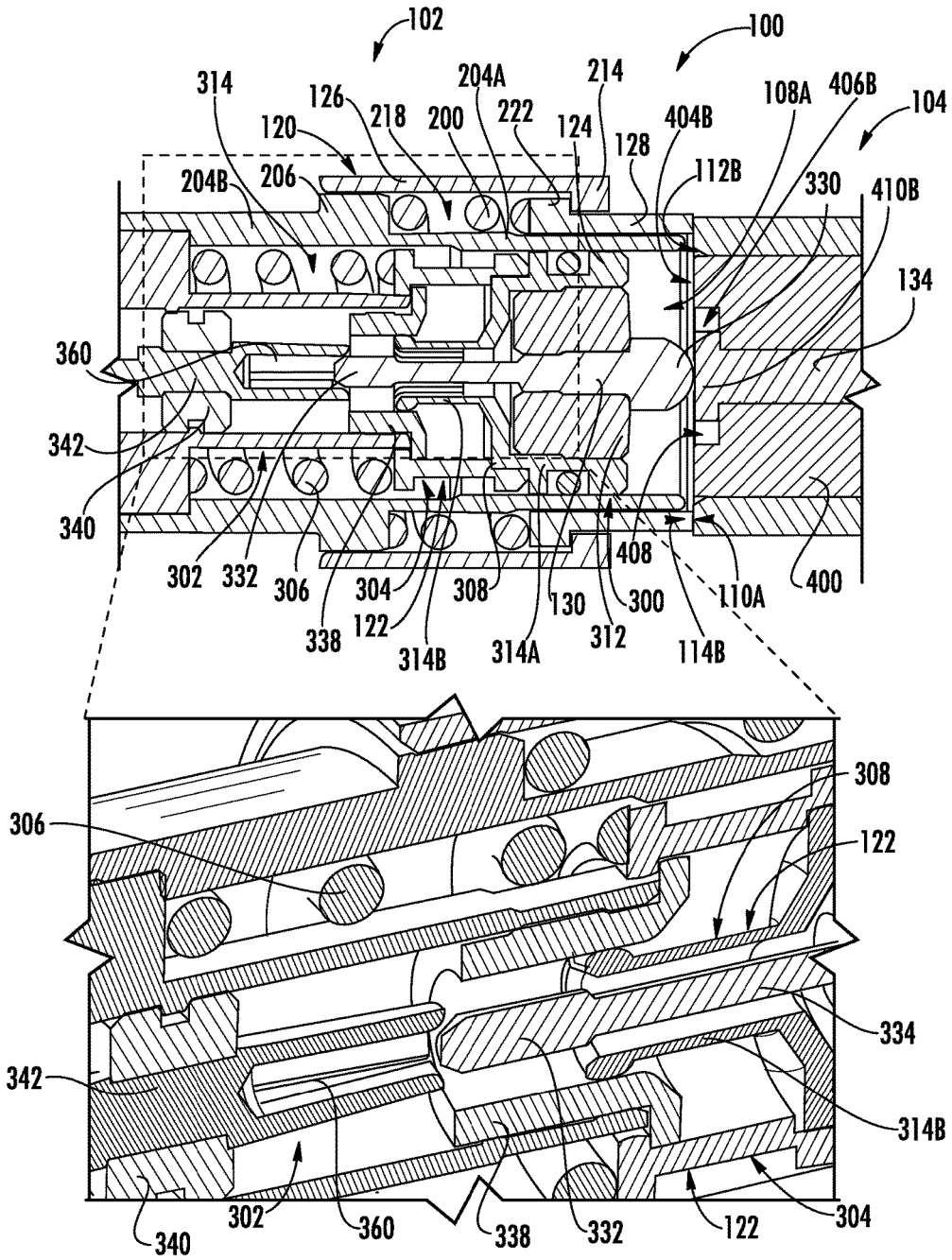
FIG. 4C is a cross-sectional side view of the coaxial connector of FIG. 4A illustrating axial translation of the grounding collar and initial contact of the first conductor with the first mating connector, as well as a close-up of a portion thereof highlighting a gap between the first conductor and the second conductor.

In FIG. 4C, the coaxial connector grounding collar 128 maintains contact with the first mating connector housing 132 and axially translates relative to the housing assembly housing 124. The first conductor 130 then makes initial contact with the first mating connector conductor 134 establishing an electrical path from the first mating connector 104 to the first conductor 130. However, the first conductor 130 remains separated from the second conductor 342, and so the electrical path does not extend to the second conductor 342.

Figure 4D:
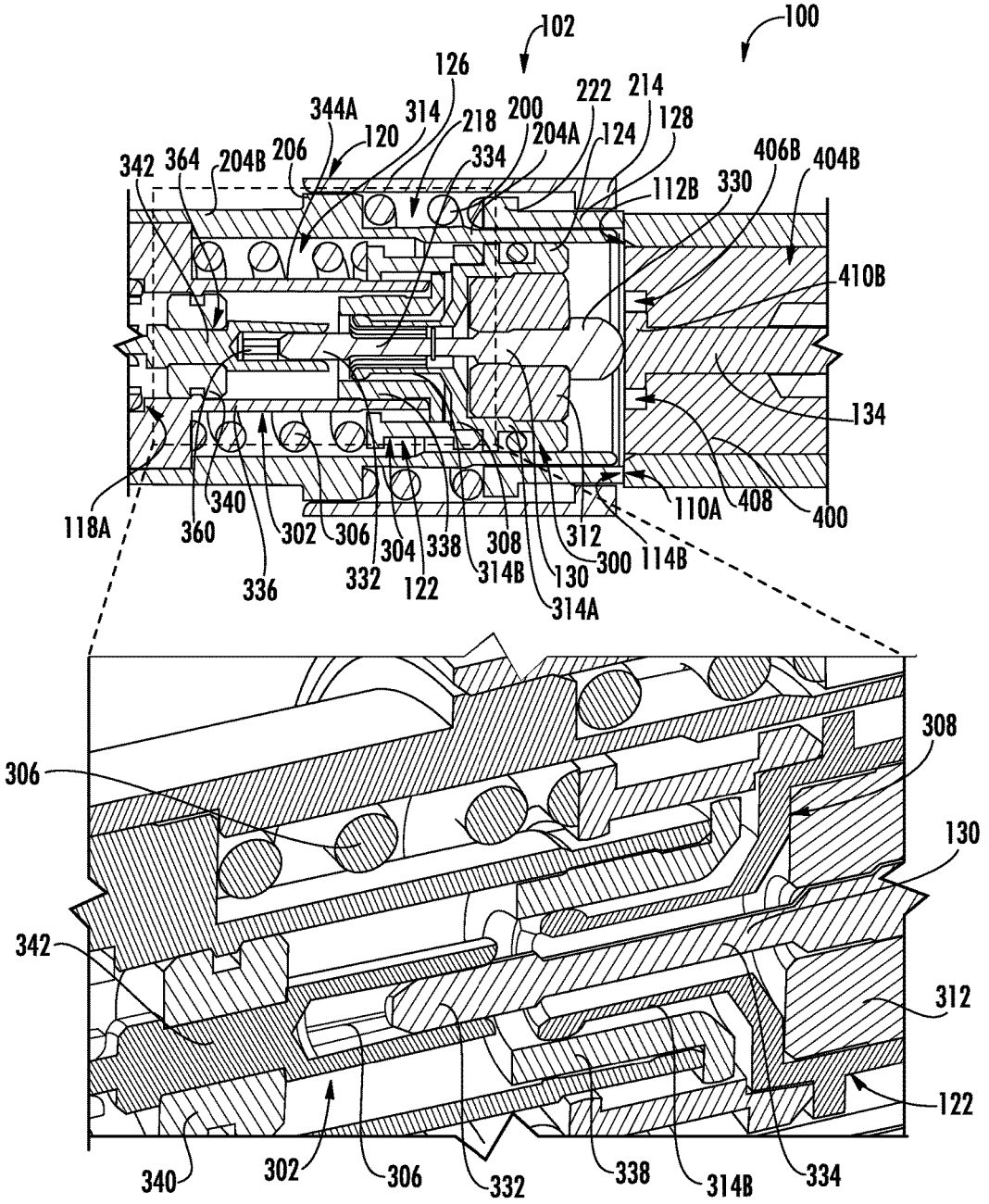
FIG. 4D is a cross-sectional side view of the coaxial connector of FIG. 4A illustrating axial translation of the grounding collar and first conductor, as well as a close-up of a portion thereof highlighting contact between the first conductor and the second conductor.

In FIG. 4D, as the first mating connector 104 continues to axially translate towards the coaxial connector 102, the grounding collar 128 and first conductor 130 axially translate together. In other words, once the grounding collar 128 and the first conductor 130 are in contact with the first mating connector 104, they axially translate together towards the coaxial connector second end 110B, at least until the first conductor 130 establishes contact with the second conductor 342. As shown, the first mating connector 104 is in a mated orientation (e.g., compressed orientation).

At maximum compression of the coaxial connector 102, the first conductor housing 308 contacts the second conductor bushing 338, preventing any further axial translation of the first conductor subassembly 300 towards the second conductor subassembly 302. As shown, when the first conductor 130 axially translates towards the coaxial connector second end 110B, the first conductor second male cylindrical contact 332 inserts into and makes contact with the second conductor female socket contact 360. Accordingly, an electrical path is established and maintained from the first mating connector conductor 134 to the coaxial connector first conductor 130, to the coaxial connector second conductor 342, and to the second mating connector 106. Further, a grounding path is established and maintained from the first mating connector housing 132, to the coaxial connector grounding collar 128, to the coaxial connector housing assembly housing 124 (e.g., via the outer spring 200), to the coaxial connector second conductor housing 336, and to the second mating connector 106. More specifically, when fully mated, the grounded components of the coaxial connector 102 include the housing assembly 120 (e.g., the housing 124, the outer shell 126, the grounding collar 128, the outer spring 200), the first conductor housing 308, the intermediate bushing 304, the inner spring 306, and the second conductor housing 336.

Figure 5:
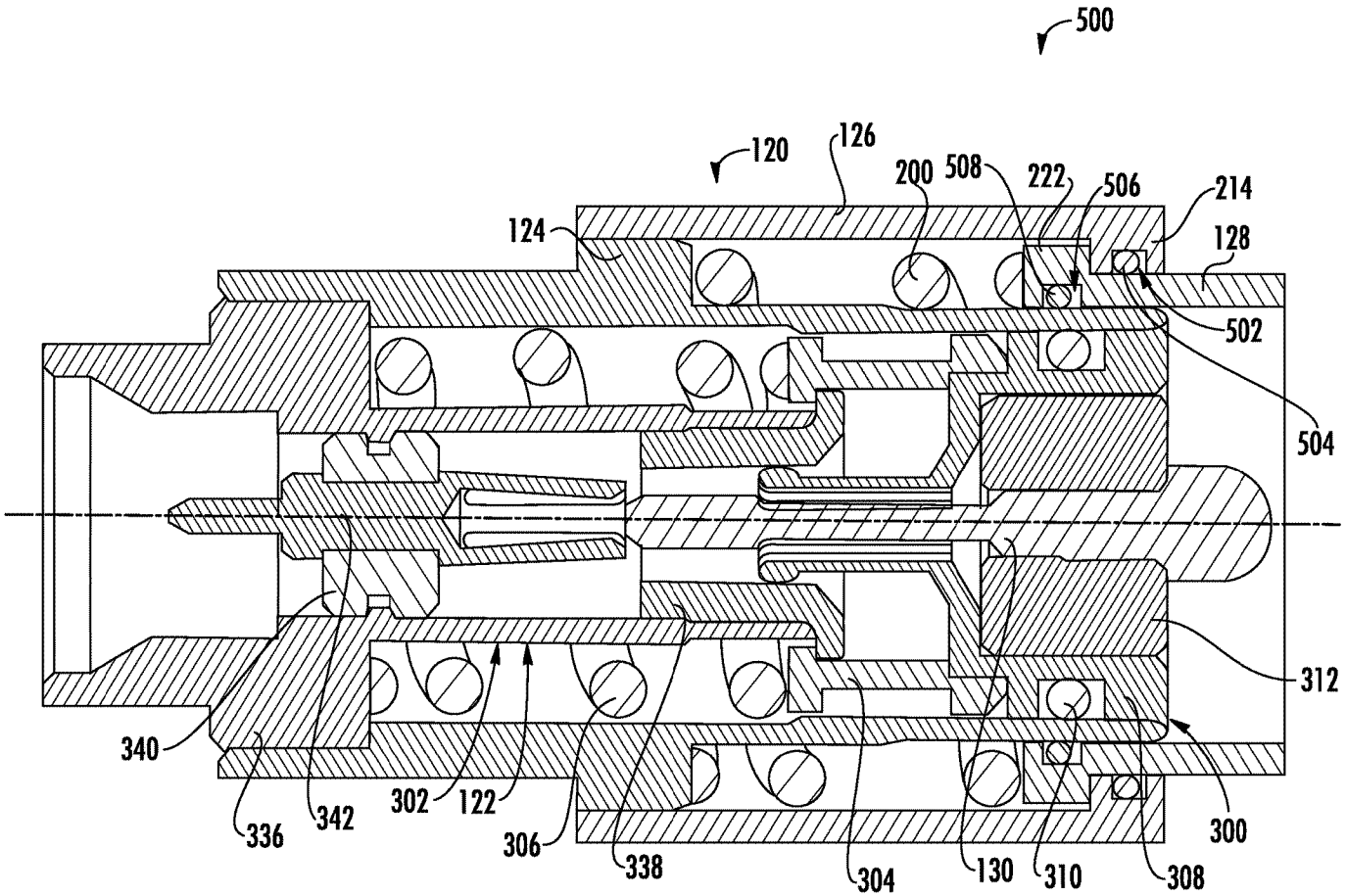
FIG. 5 is a cross-sectional side view of another embodiment of the coaxial connector of FIGS. 1A-4D, the housing assembly of the coaxial connector comprising a plurality of O-rings.
Figure 6:
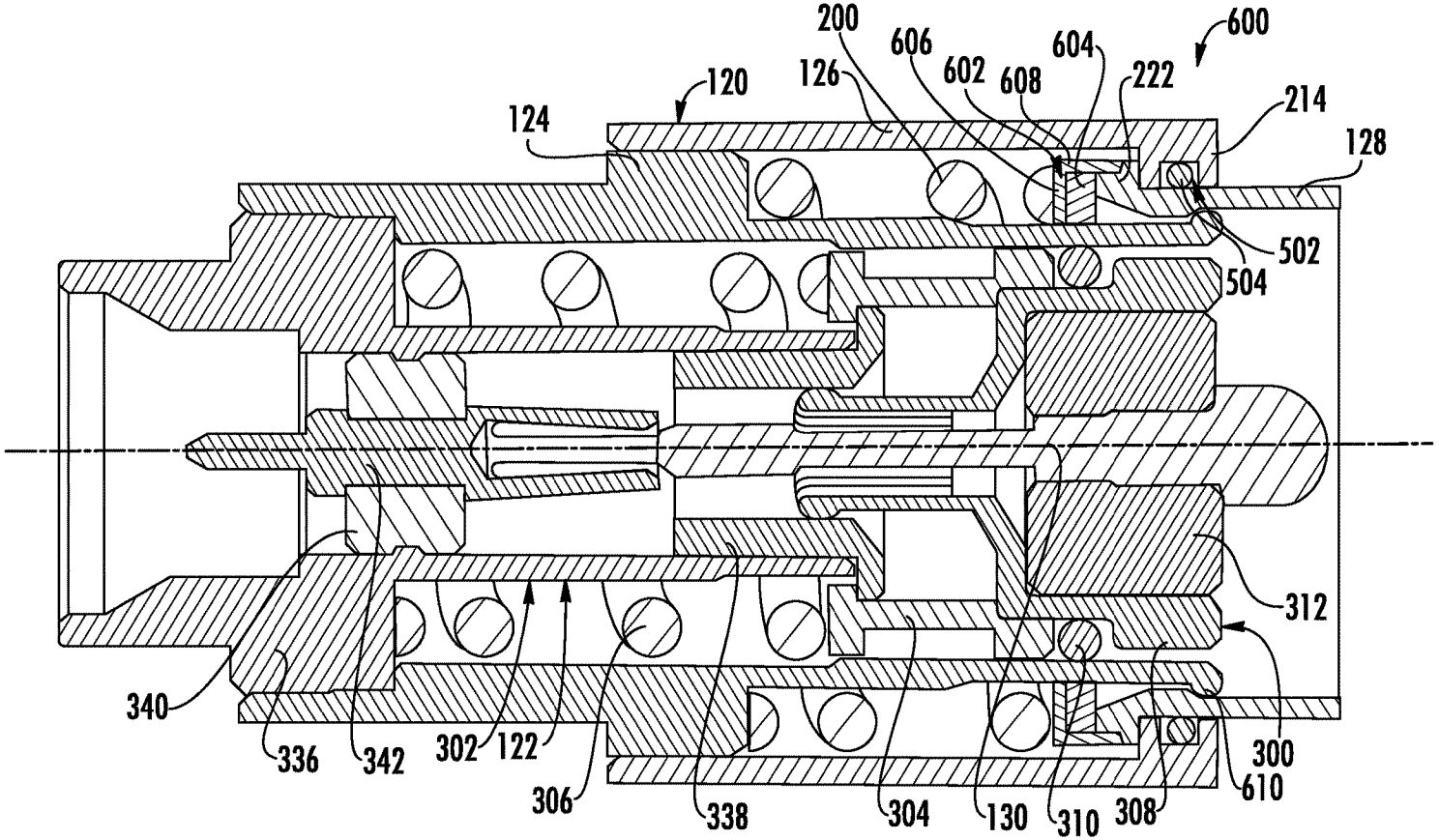
FIG. 6 is a cross-sectional side view of another embodiment of the coaxial connector of FIG. 5 with an annular L-bracket protecting a gasket of the housing assembly and the housing comprising a bulbous rim.
Figure 7:
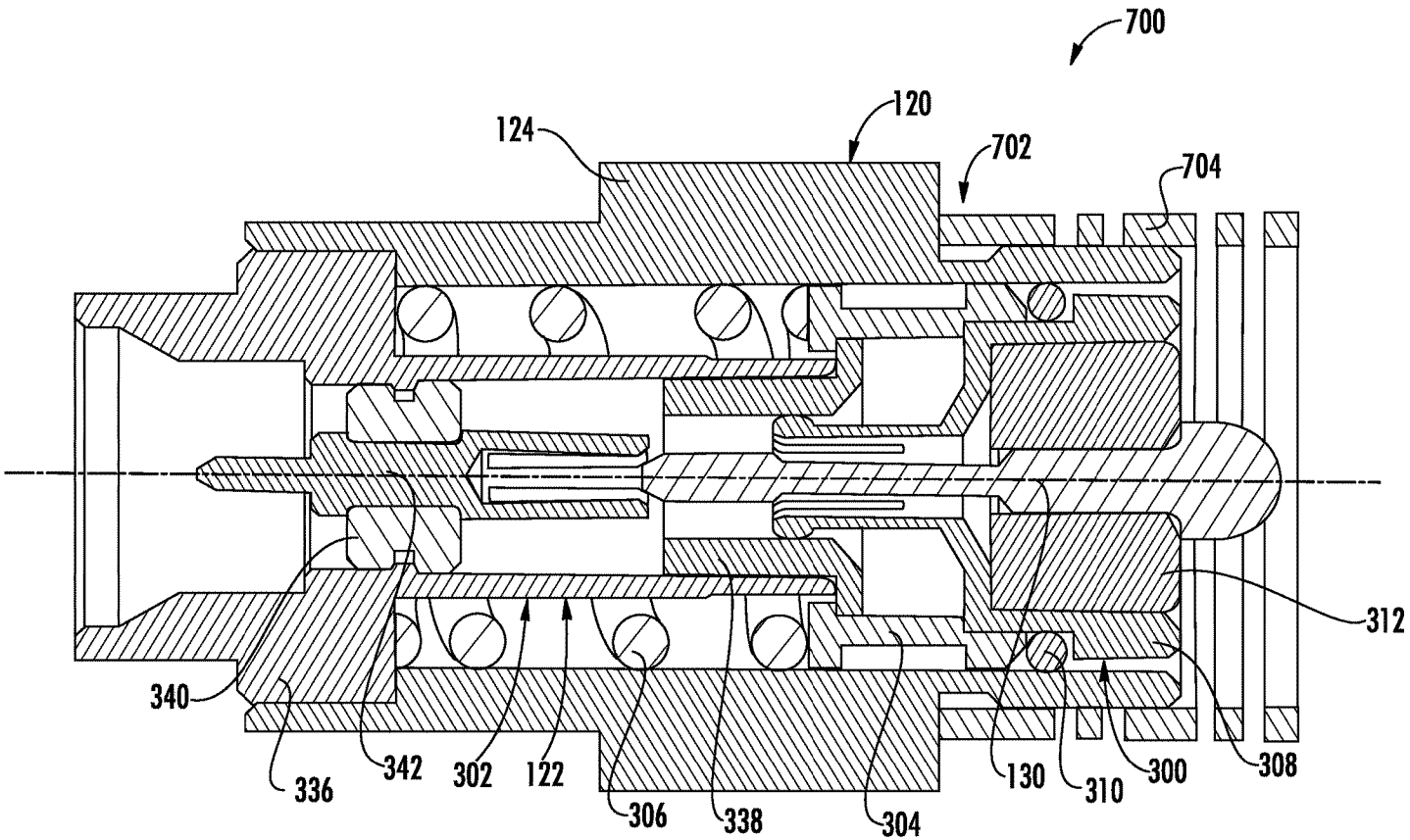
FIG. 7 is a cross-sectional side view of another embodiment of the coaxial connector of FIGS. 1A-4D with the housing comprising a grounding spring to provide a grounding path.

FIGS. 5-7 are cross-sectional views of alternative embodiments of the coaxial connector 102 of FIGS. 1A-4D. Each alternative embodiment comprises similar components with similar functionality except where otherwise noted. More specifically, FIG. 5 is a cross-sectional side view of a coaxial connector 500, and contains the same components and operates the same as the coaxial connector 102 of FIGS. 1A-4D except that the coaxial connector 500 includes an additional two O-rings. More specifically, the outer shell inward annular flange 214 comprises an inner groove 502 on an inner surface thereof. An outer shell O-ring 504 is positioned within the inner groove 502 to provide a seal (but allow relative movement) between the outer shell inward annular flange 214 and the outer surface of the grounding collar 128. Further, the grounding collar 128 comprises an inner groove 506 on an inside surface proximate the second opening 220B. A grounding collar O-ring 508 is positioned within the inner groove 506 to provide a seal (but allow relative movement) between the grounding collar 128 and the housing assembly housing 124. Accordingly, the two O-rings 504, 508 seal the gap 218 between the housing assembly housing 124 and the outer shell 126, but allow translation of the grounding collar 128 relative to the housing 124 and the outer shell 126.

FIG. 6 is a cross-sectional side view of a coaxial connector 600, and contains the same components and operates the same as the coaxial connector 102 of FIGS. 1A-4D except that the coaxial connector includes an outer shell O-ring 504 and an annular L-bracket 602 protecting a gasket 604. More specifically, as with the coaxial connector 500 of FIG. 5, the coaxial connector 600 comprises an outer shell O-ring 504 positioned within the inner groove 502 to provide a seal (but allow relative movement) between the outer shell inward annular flange 214 and the outer surface of the grounding collar 128. Further, the coaxial connector 600 comprises an annular L-bracket 602 positioned between the outer spring 200 and the grounding collar 128. More specifically, the L-bracket 602 comprises a first portion 606 and a second portion 608 perpendicular to the first portion at an outside end of the first portion 606. The L-bracket first portion 606 is positioned between the outer spring 200 and the grounding collar 128. The gasket 604 is positioned between the L-bracket first portion 606 and the grounding collar 128, and the gasket 604 is positioned between the L-bracket second portion 608 and the housing assembly housing 124. Accordingly, the outer shell O-ring 504 and gasket 604 seal the gap 218 between the housing assembly housing 124 and the outer shell 126. Additionally, the housing assembly housing 124 comprises a bulbous rim 610 that engages an inner contoured surface of the grounding collar 128 to prevent disengagement of the grounding collar 128 from the housing assembly housing 124.

FIG. 7 is a cross-sectional side view of a coaxial connector 700, and contains the same components and operates the same as the coaxial connector 102 of FIGS. 1A-4D except that the grounding collar 702 comprises a spring 704. In this manner, when the first mating connector 104 contacts the grounding collar 702, the grounding collar 702 compresses between the first mating connector 104 and the housing assembly housing outer shoulder 206.

Figure 8:
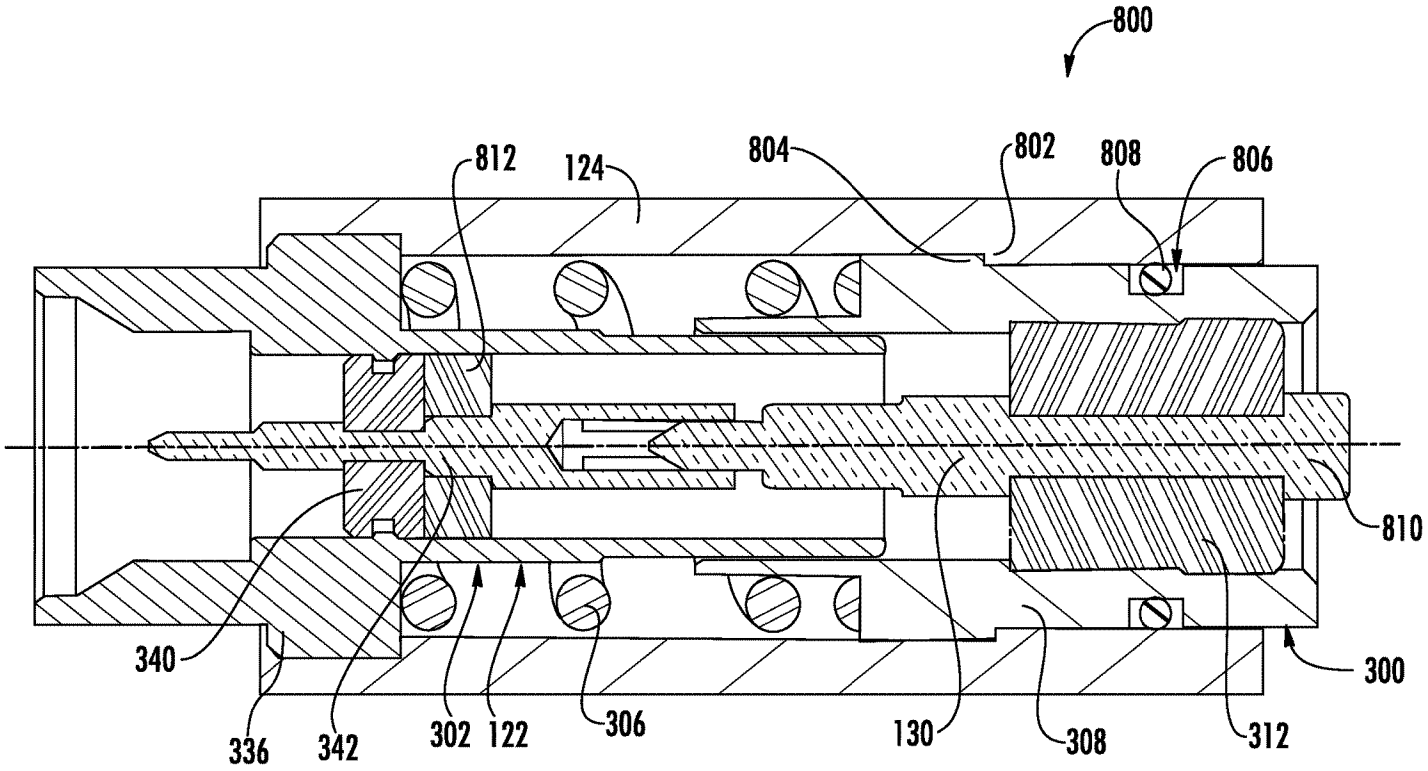
FIG. 8 is a cross-sectional side view of another embodiment of the coaxial connector of FIGS. 1A-4D with complementary shoulders attaching the housing assembly housing and first conductor housing together.
Figure 9:
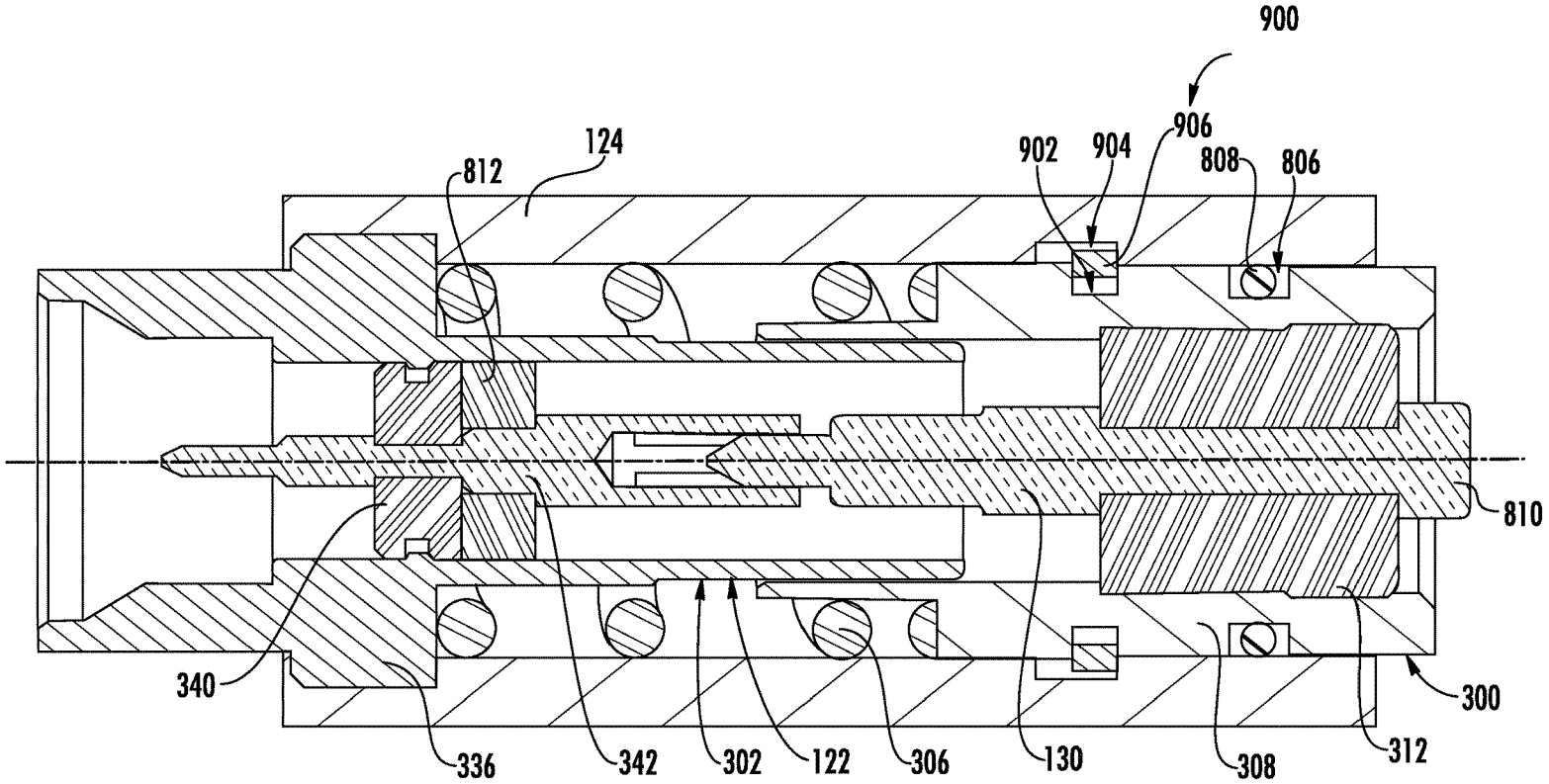
FIG. 9 is a cross-sectional side view of another embodiment of the coaxial connector of FIG. 8 with a c-ring attaching the housing assembly housing and first conductor housing together.
Figure 10:
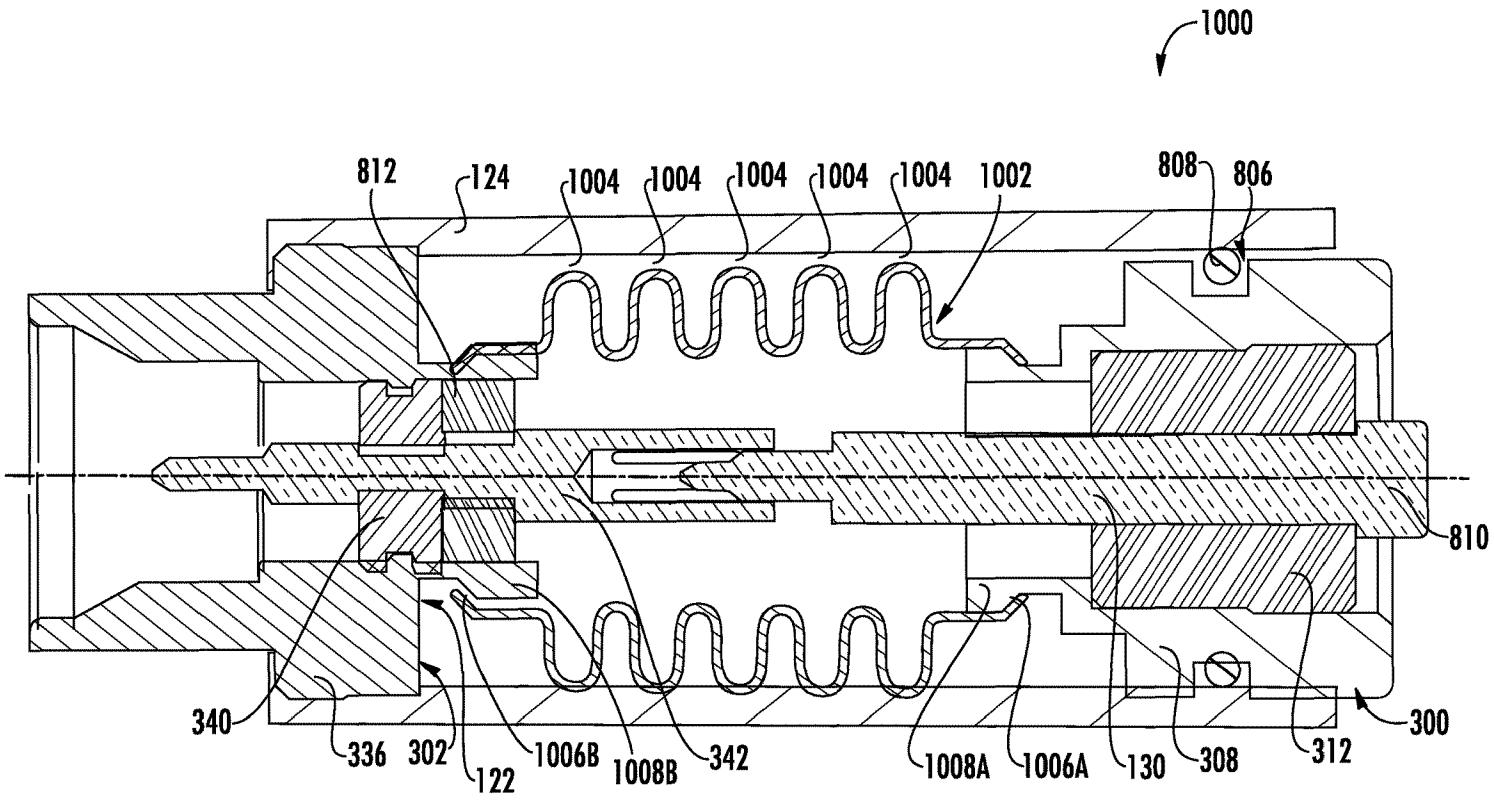
FIG. 10 is a cross-sectional side view of another embodiment of the coaxial connector of FIGS. 8-9 with a bellows attaching the first conductor housing to the second conductor housing and providing axial translation therebetween.

FIGS. 8-10 are cross-sectional views of alternative embodiments of the coaxial connector 102 of FIGS. 1A-4D without a grounding collar 128. Each alternative embodiment comprises similar components with similar functionality except where otherwise noted. More specifically, FIG. 8 is a cross-sectional side view of a coaxial connector 800, and contains the same components and operates the same as the coaxial connector 102 of FIGS. 1A-4D except where otherwise noted. The coaxial connector 800 does not comprise a grounding collar 128 but instead relies upon the housing assembly housing 124 and the first conductor housing 308 to establish a grounding connection. Additionally, the first conductor 130 is in electrical communication with the second conductor 342 in an uncompressed orientation. However, the first conductor 130 is still axially translatable relative to the second conductor 342 upon contact with the first mating connector 104 to compensate for tolerance stack variability.

The housing assembly housing 124 comprises an inner shoulder 802 positioned towards the coaxial connector first end 110A. The first conductor housing 308 comprises an outer shoulder 804, complementary in size and shape with the inner shoulder 802, to prevent the first conductor housing 308 from disengaging from the housing assembly housing 124. Further, the first conductor housing 308 comprises an outer annular groove 806 with an O-ring 808 positioned therein. The O-ring 808 seals an interior of the housing assembly housing 124. The first conductor housing 308 is configured to receive a portion of the second conductor housing 336 (e.g., the second conductor housing first opening 346A) within the first conductor housing interior 316C. The first conductor first male contact 810 is planar instead of hemispherical, although any other suitable shape could be used. Further, the first conductor 130 extends past an end of the first conductor housing 308. The second conductor subassembly 302 further comprises a stabilizing ring 812 positioned around the second conductor 342 proximate the second conductor dielectric cylinder 340. The stabilizing ring 812 provides additional mounting stability of the second conductor 342 to the second conductor housing 336.

FIG. 9 is a cross-sectional side view of a coaxial connector 900, and contains the same components and operates the same as the coaxial connector 800 of FIG. 8 except where otherwise noted. In particular, instead of shoulders 802, 804, the first conductor housing 308 comprises a second outer annular groove 902 disposed more towards the coaxial connector second end 110B than the O-ring 808. Further, the housing assembly housing 124 comprises an inner annular groove 904 positioned proximate the second outer annular groove 902. A c-ring 906 is positioned within the second outer annular groove 902 and the inner annular groove 904, and extends from the second outer annular groove 902 to the inner annular groove 904. Accordingly, the first conductor subassembly 300 axially translates towards the second conductor subassembly 302 upon contact with the first mating connector 104. Upon doing so, the c-ring 906 translates relative to the inner annular groove 904, as the inner annular groove 904 is axially longer than the second outer annular groove 902. However, the inner annular groove 904 provides a maximum limit on the axial translation of the first conductor subassembly 300 within the housing 124 and prevents the first conductor 130 from bottoming out against the second conductor 342, and potentially damaging the coaxial connector 900.

FIG. 10 is a cross-sectional side view of a coaxial connector 1000, and contains the same components and operates the same as the coaxial connectors 800, 900 of FIGS. 8 and 9 except where otherwise noted. More specifically, the first conductor housing 308 and second conductor housing 336 are separated from but attached to one another by a bellows 1002 positioned therebetween. The bellows 1002 comprises a plurality of axially aligned ribs 1004 that bend and compress to allow the ends of the bellows 1002 to stretch and compress. The bellows 1002 further comprises a first inwardly tapered end 1006A and a second inwardly tapered end 1006B (opposite the first end). The first inwardly tapered end 1006A is frictionally engaged and fixedly attached to an outwardly tapered end 1008A of the first conductor housing 308 (e.g., towards the coaxial connector second end 110B). The second inwardly tapered end 1006B is frictionally engaged and fixedly attached to an outwardly tapered end 1008B of the second conductor housing 336 (e.g., towards the coaxial connector first end 110A). Accordingly, as the first mating connector 104 mates with the coaxial connector 1000, the first conductor subassembly 300 axially translates towards the second conductor subassembly 302 as the bellows 1002 compresses. In this manner, the coaxial connector 1000 compensates for tolerance stack variability.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. A coaxial connector, comprising:

a housing comprising a housing first end and a housing second end;

a first conductor mounted within and electrically insulated from the housing; and a grounding collar mounted to and in electrical communication with the housing with at least a portion of the first conductor positioned within the grounding collar, the grounding collar biased towards the housing first end and configured to axially translate towards the housing second end upon contact with a first connector;

wherein the coaxial connector is configured to establish an electrical path between the first conductor and the first connector after establishing a grounding path between the grounding collar and the first connector, and after axial translation of the grounding collar.

2. The coaxial connector of claim 1, further comprising:

an outer shell fixedly attached to the housing; and a gap defined between the housing and the outer shell, wherein at least a portion of the grounding collar is positioned and translatable within the gap.

3. The coaxial connector of claim 2, further comprising a first spring positioned within the gap, the first spring biasing the grounding collar towards the housing first end.

4. The coaxial connector of claim 3, wherein the grounding collar further comprises an outward annular flange and the outer shell comprises an inward annular flange, the outward annular flange and the inward annular flange configured to retain at least the outward annular flange within the gap.

5. The coaxial connector of claim 4, wherein the first conductor is biased towards the housing first end and configured to axially translate towards the housing second end upon contact of the first conductor with the first connector.

6. The coaxial connector of claim 5, wherein the grounding collar and the first conductor are independently biased.

7. The coaxial connector of claim 6, further comprising a second spring positioned within the housing, the second spring biasing the first conductor towards the housing first end.

8. The coaxial connector of claim 7, wherein the second spring has a smaller diameter than the first spring.

9. The coaxial connector of claim 8, further comprising a second conductor mounted within and electrically insulated from the housing, the second conductor axially aligned with the first conductor and positioned towards the housing second end relative to the first conductor.

10. The coaxial connector of claim 9, wherein the second conductor is fixedly attached to the housing, and the first conductor and the second conductor are configured to be separated from one another when the coaxial connector is in an unmated orientation.

11. The coaxial connector of claim 10, wherein the first conductor and the second conductor are configured to contact each other when the first conductor axially translates towards the housing second end upon contact of the first conductor with the first connector.

12. A coaxial connector, comprising:

a housing comprising a housing first end and a housing second end;

a first conductor comprising a first conductor first end and a first conductor second end, the first conductor first end configured to contact a first connector, the first conductor mounted within the housing towards the housing first end by a first dielectric, the first conductor electrically insulated from the housing by the first dielectric, the first conductor biased towards the housing first end and configured to axially translate towards the housing second end upon contact of the first conductor first end with the first connector;

a second conductor comprising a second conductor first end and a second conductor second end, the second conductor second end configured to contact a second connector, the second conductor electrically insulated from the housing by a second dielectric, the second conductor mounted within the housing towards the housing second end by the second dielectric, the second conductor fixed relative to the housing; and a grounding collar mounted to and in electrical communication with the housing with at least a portion of the first conductor positioned within the grounding collar, the grounding collar biased towards the housing first end and configured to axially translate towards the housing second end upon contact with the first connector;

wherein the coaxial connector is configured to establish an electrical path between the first conductor and the first connector after establishing a grounding path between the grounding collar and the first connector, and after axial translation of the grounding collar; and wherein the coaxial connector is configured to establish electrical contact between the first conductor second end and the second conductor first end after axial translation of the first conductor.

13. The coaxial connector of claim 12, further comprising:

an outer shell fixedly attached to the housing; and a gap defined between the housing and the outer shell, wherein at least a portion of the grounding collar is positioned and translatable within the gap.

14. The coaxial connector of claim 13, further comprising a first spring positioned within the gap, the first spring biasing the grounding collar towards the housing first end.

15. The coaxial connector of claim 14, wherein the grounding collar further comprises an outward annular flange and the outer shell comprises an inward annular flange, the outward annular flange and the inward annular flange configured to retain at least the outward annular flange within the gap.

16. The coaxial connector of claim 15, wherein the grounding collar and the first conductor are independently biased.

17. The coaxial connector of claim 16, further comprising a second spring positioned within the housing, the second spring biasing the first conductor towards the housing first end.

18. The coaxial connector of claim 17, wherein the second spring has a smaller diameter than the first spring.

19. The coaxial connector of claim 18, wherein the second conductor is fixedly attached to the housing, and the first conductor and the second conductor are configured to be separated from one another when the coaxial connector is in an unmated orientation.

20. The coaxial connector of claim 19, wherein the first conductor and the second conductor are configured to contact each other when the first conductor axially translates towards the housing second end upon contact of the first conductor with the first connector.

* * * * *